US011249432B2

(12) United States Patent
Komiyama et al.

(10) Patent No.: US 11,249,432 B2
(45) Date of Patent: Feb. 15, 2022

(54) SHEET PROCESSING APPARATUS AND IMAGE FORMING SYSTEM HAVING THE SAME

(71) Applicants: Daiki Komiyama, Yamanashi-ken (JP); Akihiko Tsukui, Yamanashi-ken (JP)

(72) Inventors: Daiki Komiyama, Yamanashi-ken (JP); Akihiko Tsukui, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 11 days.

(21) Appl. No.: 16/775,890

(22) Filed: Jan. 29, 2020

(65) Prior Publication Data

US 2020/0264550 A1 Aug. 20, 2020

(30) Foreign Application Priority Data

Feb. 15, 2019 (JP) ..... JP2019-025251
Feb. 15, 2019 (JP) ..... JP2019-025257

(51) Int. Cl.
*G03G 15/00* (2006.01)
*B65H 37/04* (2006.01)

(52) U.S. Cl.
CPC ..... *G03G 15/6541* (2013.01); *B65H 37/04* (2013.01)

(58) Field of Classification Search
CPC ..... B65H 2404/732
See application file for complete search history.

(56) References Cited

U.S. PATENT DOCUMENTS

2002/0158405 A1* 10/2002 Nagasako ..... B65H 31/24 271/213
2013/0038013 A1* 2/2013 Arai ..... B65H 31/38 270/58.17

FOREIGN PATENT DOCUMENTS

JP 2002-179326 A 6/2002
JP 2006-206332 A 8/2006
JP 2010074625 A * 4/2010
JP 2015-117076 A 6/2015
JP 2015-124084 A 7/2015

* cited by examiner

*Primary Examiner* — Jennifer Bahls
(74) *Attorney, Agent, or Firm* — Manabu Kanesaka

(57) ABSTRACT

A sheet processing apparatus includes a stacking section provided on the downstream side of a collecting section in a transport direction outside an apparatus housing, an alignment section provided on the downstream side of the collecting section in the transport direction, above the stacking section, to be able to shift in a predetermined movable region so as to align a sheet width direction orthogonal to the transport direction of the sheet to be stacked on the stacking section, a shaft-direction drive mechanism for shifting the alignment section in the width direction orthogonal to the transport direction, an alignment plate rotation shaft member for axially supporting the alignment section rotatably, a shaft-direction drive source for operating the shaft-direction drive mechanism, and a neat housing for storing the shaft-direction drive mechanism and the alignment plate rotation shaft member inside the housing.

11 Claims, 16 Drawing Sheets

FIG. 17A
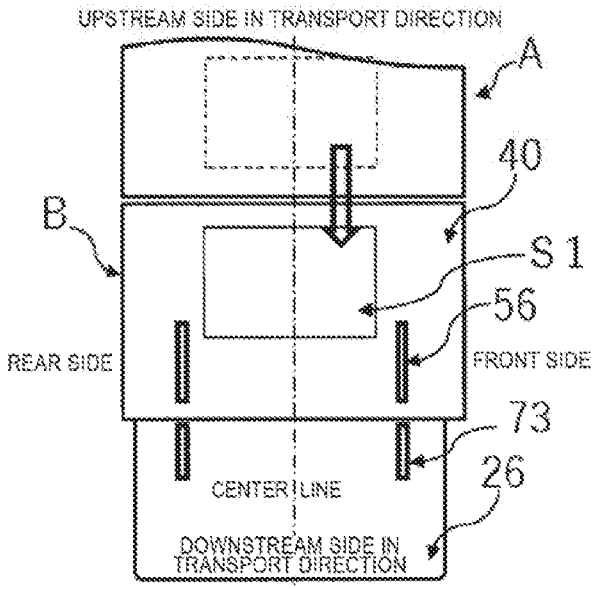
FIG. 17B
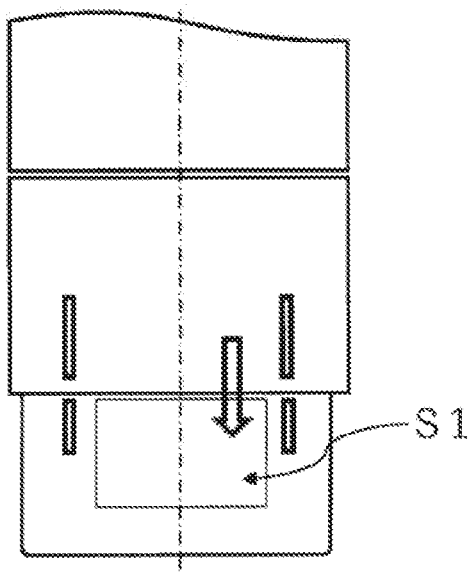
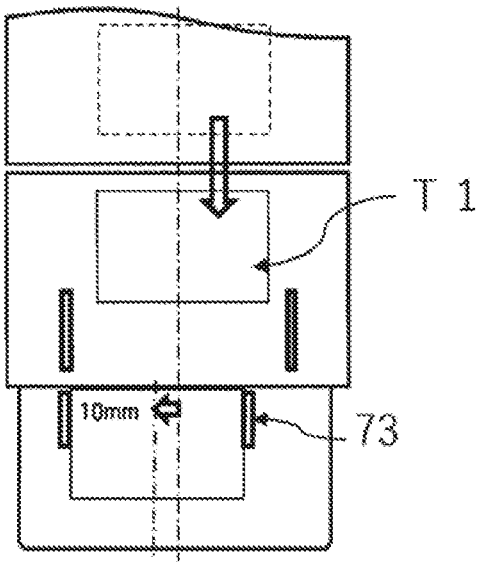
FIG. 17C
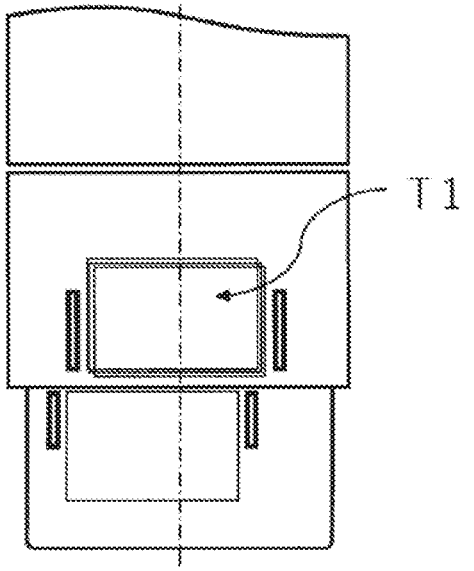
FIG. 17D

FIG. 18E
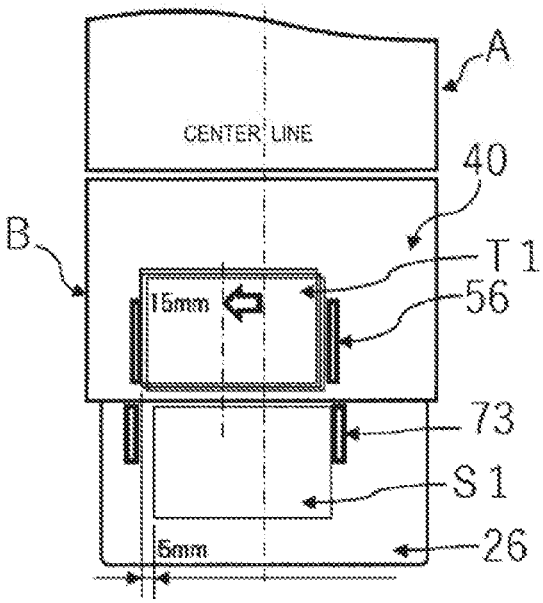
FIG. 18F
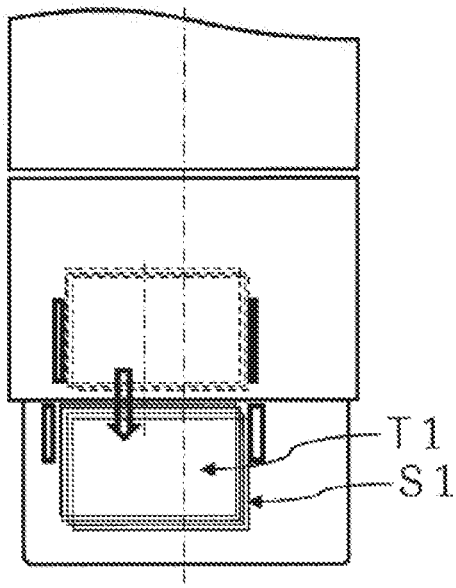
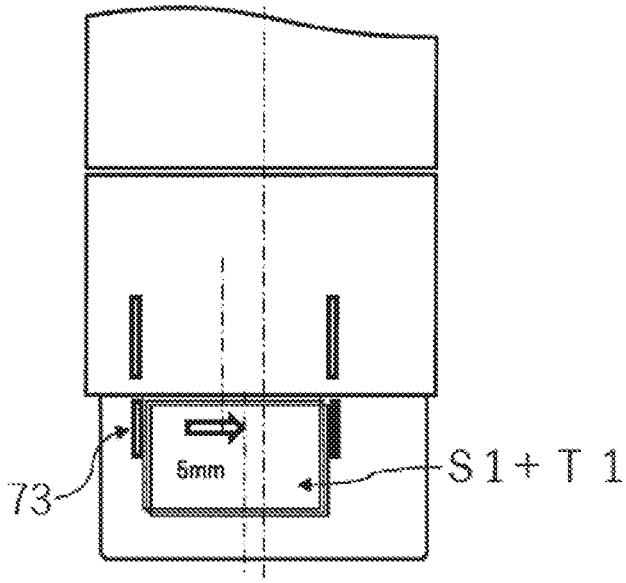
FIG. 18G

SHEET PROCESSING APPARATUS AND IMAGE FORMING SYSTEM HAVING THE SAME

BACKGROUND OF THE INVENTION

1. Field of the Invention

The present invention relates to a sheet stacking apparatus for discharging a sheet from a discharge opening to stack on a stacking section, and an image forming system provided with the sheet stacking apparatus.

2. Description of Related Arts

Conventionally, there has been a known sheet processing apparatus which performs post-processing on a sheet fed from an image forming apparatus such as a copier and printer to stack on a stacking means. Generally, this type of sheet processing apparatus is known as an apparatus which is coupled to a sheet discharge opening of the image forming apparatus, temporarily holds the image-formed sheet in a transport path or on a collecting means to perform post-processing, and then, collects on a collection tray to store. As the post-processing, known is punching processing for punching a punch hole in a sheet, binding processing for binding a sheet bunch obtained by collecting sheets, stamp processing for putting a stamp on a sheet, folding processing for folding a sheet and the like.

For example, Patent Documents 1 and 2 disclose an apparatus which is coupled to a sheet discharge opening of an image forming apparatus, guides an image-formed sheet from a carry-in path to a collecting means to collate and collect in the shape of a bunch, performs binding processing, and then, stacks on a stacking means on the downstream side to store. Further, a stack tray of this apparatus is capable of moving up and down to align a sheet discharge height corresponding to a stack amount, and above the stack tray is provided a second tray which does not include a vertical-direction position shift mechanism.

Further, Patent Documents 3 and 4 disclose a sheet processing apparatus provided with the so-called neat alignment apparatus where a pair of aligning members is pivotally fitted slidably to a shaft supported by an apparatus housing of the sheet processing apparatus so as to extend in a direction (hereinafter, described as a shift direction) orthogonal to the discharge direction of the sheet above the stacking means, and in a state in which the pair of aligning members is moved downward onto the stacking means, the members are brought into contact with two end faces parallel with the discharge direction of the sheet stacked on the stacking means so as to nip the end faces, and thereby align the sheet in a predetermined position in the shift direction. A shaft-direction drive mechanism for shifting the pair of aligning members in the shaft direction, and a rotation drive mechanism for rotating around the shaft are controlled by a control section of the sheet processing apparatus for controlling operation of the entire sheet processing apparatus. By providing such a pair of aligning members, it is possible to align sheets stacked on the stacking means and collate with high accuracy.

PRIOR ART DOCUMENT

Patent Document

[Patent Document 1] Japanese Patent Application Publication No. 2015-117076

[Patent Document 2] Japanese Patent Application Publication No. 2015-124084

[Patent Document 3] Japanese Patent Application Publication No. 2002-179326

[Patent Document 4] Japanese Patent Application Publication No. 2006-206332

DISCLOSURE OF INVENTION

Problems to be Solved by the Invention

In the sheet processing apparatus as described above, it is general that a collecting means is provided with an alignment apparatus for aligning a width direction of a sheet so as to collate and collect the sheet in a predetermined position on the collecting means, and after aligning the sheet in the predetermined position in the sheet width direction crossing a discharge direction on the collecting means, it is possible to discharge to the stacking means. In other words, only the alignment apparatus on the collecting means is capable of aligning in the position to some extent in the direction crossing the discharge direction to stack the sheet on the stacking means.

However, in the case of attaching a neat alignment apparatus to a sheet stacking apparatus provided with a second tray above a stack tray so as to more enhance accuracy of sheet alignment, since the second tray, neat alignment apparatus and stack tray are in a dense state, there is a problem that such a state interferes with removal of sheets placed on the stack tray.

Accordingly, it is an object of the present invention to make a compact layout of an apparatus to align a sheet on the stacking means, without interfering with removal of the sheet on the stack tray.

SUMMARY OF THE INVENTION

In order to attain the above-mentioned object, a sheet processing apparatus of the present invention is provided with an apparatus housing, a transport section provided inside the apparatus housing to transport a sheet in a predetermined transport direction, a collecting section for collecting sheets transported by the transport section to perform predetermined processing, a discharge section for transporting the sheets from the collecting section, a stacking section provided on a downstream side of the collecting section in the transport direction outside the apparatus housing to stack sheets transported by the transport section or the discharge section, an alignment section provided on the downstream side of the collecting section in the transport direction, above the stacking section, to be able to shift in a predetermined movable region so as to align a sheet width direction orthogonal to the transport direction of the sheet to be stacked on the stacking section, a shaft-direction drive mechanism for shifting the alignment section in the width direction orthogonal to the transport direction, an alignment plate rotation shaft member for axially supporting the alignment section rotatably, a shaft-direction drive source for operating the shaft-direction drive mechanism, and a neat housing for storing the shaft-direction drive mechanism and the alignment plate rotation shaft member inside the housing, where the shaft-direction drive source is disposed on the downstream side of the alignment plate rotation shaft member in the transport direction, inside the neat housing.

BRIEF DESCRIPTION OF THE DRAWINGS

FIG. 5A illustrates a state in which a sheet bunch is positioned in a binding position on a collecting means, FIG. 5B illustrates a state in which the sheet bunch is being shifted from a processing position to the downstream side, and FIG. 5C illustrates a state immediately before carrying out the sheet bunch to a first stacking means on the downstream side;

FIGS. 17A to 17D contain explanatory views of jog sorting operation; and FIGS. 18E to 18G contain explanatory views of jog sorting operation.

DETAILED DESCRIPTION OF THE PREFERRED EMBODIMENT

Figure 1:
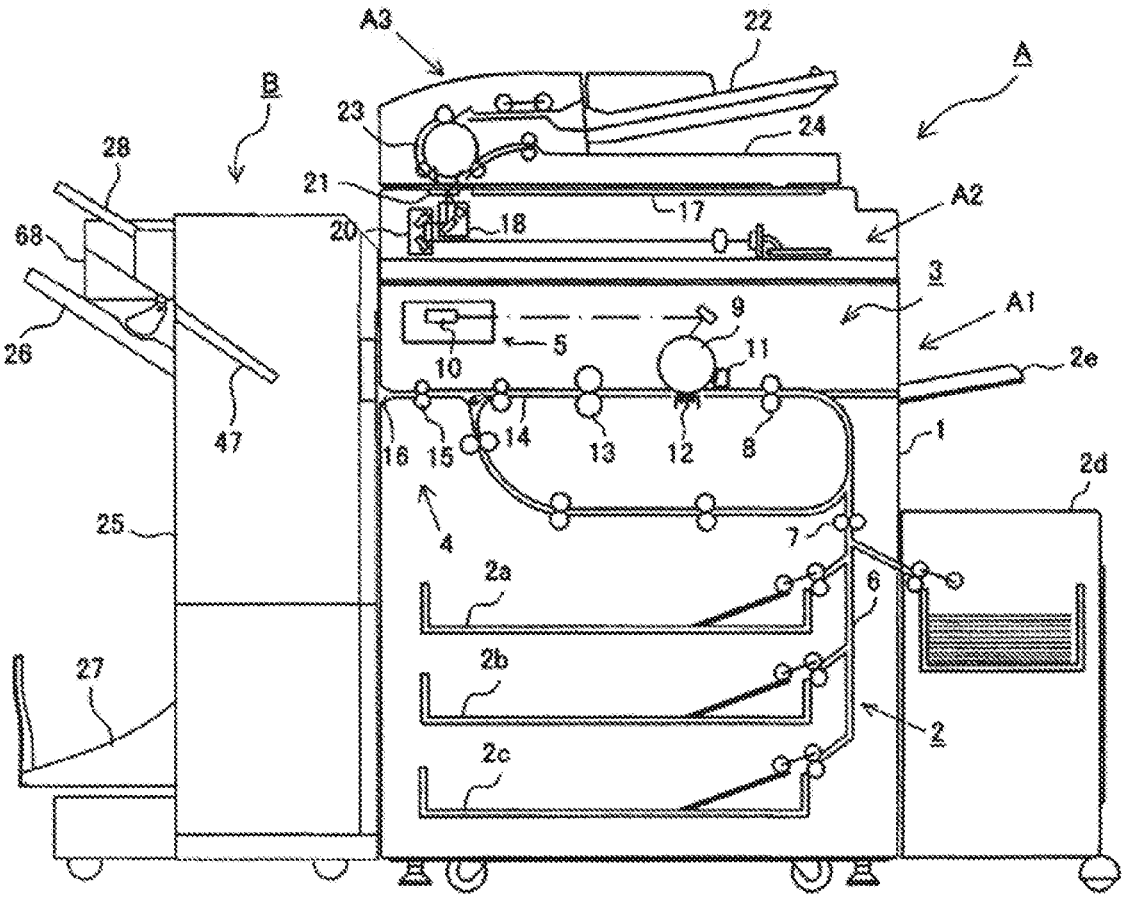
FIG. 1 is an entire configuration view of an image forming system provided with a sheet processing apparatus of the present invention.

The preferred Embodiment of the present invention will be described below in detail with reference to accompanying drawings. In the accompanying drawings, similar components will be shown by assigning the same reference numerals.

In addition, in the present Description, "offset transport of a sheet bunch" means that a sheet bunch obtained by collecting sheets carried on a stacking means from a sheet discharge opening is shifted (width aligning shift) in a direction orthogonal to (or crossing) a sheet transport direction, and "offset amount" means a shift amount in the direction orthogonal to (or crossing) the sheet transport direction in offset-transporting a sheet bunch. Further, "alignment of a sheet bunch" means that with respect to a plurality of sheets carried on the stacking means from the sheet discharge opening and a sheet discharged onto the stacking means from the discharge opening, a sheet bunch is placed in a beforehand determined posture and position according to predetermined reference (e.g., center reference that is a center position in the direction orthogonal to the sheet transport direction and discharge direction i.e. width direction, or one-side reference set on one side in the width direction). For example, "performing an offset after aligning sheets" means that after placing a plurality of sheets in the beforehand determined position and posture according to the reference as described previously, the entire sheet bunch of this state is shifted in the direction orthogonal to (or crossing) the sheet transport direction and discharge direction.

Referring to FIG. 1, first described is the entire configuration of an image forming system. The image forming system includes an image forming apparatus A and sheet processing apparatus B to be comprised thereof. Sheets with images formed in the image forming apparatus A are collated and collected in the sheet processing apparatus B, post-processing such as binding processing is performed on a bunch of collected sheets, and the bunch is stacked and stored in a first stacking means 26, second stacking means 27 or third stacking means 28 on the downstream side. In addition, in the present Description, it is assumed that the front side of the image forming system of FIG. 1 is referred to as the apparatus front side, and that the rear side is referred to as the apparatus rear side.

The image forming apparatus A and sheet processing apparatus B will be described below in detail.

[Image Forming Apparatus]

As shown in FIG. 1, the image forming apparatus A includes an image forming unit A1, image read unit A2 and document feed unit A3. The image forming unit A1 is provided with a paper feed section 2, image forming section 3, sheet discharge section 4 and data processing section 5 inside an apparatus housing 1.

In the Embodiment shown in the figure, the paper feed section 2 includes a plurality of cassettes 2*a*, 2*b*, 2*c*, and each of the cassettes 2*a*, 2*b*, 2*c* is capable of storing sheets of a beforehand selected different standard size. Into each of the cassettes 2*a*, 2*b*, 2*c* is incorporated a separation mechanism for separating sheets inside on a sheet-by-sheet basis, and a paper feed mechanism for feeding the sheet. With respect to the sheets stored in the paper feed section 2 of such a configuration, based on information input from a control panel 84 (see FIG. 9), a sheet of a size designated from a main body control section 80 is fed to a paper feed path 6. The paper feed path 6 is provided with a transport roller 7 disposed in an intermediate portion to feed the sheet supplied from each of the plurality of cassettes 2*a*, 2*b*, 2*c* to the downstream side, and a register roller pair 8 disposed in a path end portion to align a front end of each sheet.

Further, the paper feed path 6 is coupled to a high-capacity cassette 2*d* and manual tray 2*e*, the high-capacity cassette 2*d* is comprised of an option unit for storing sheets of a size consumed in large quantity, and the manual tray 2*e* is capable of supplying particular sheets such as thick sheets, coating sheets and film sheets difficult to feed separately.

It is essential only that the image forming section 3 is configured to form an image on a sheet fed from the paper feed section 2, and it is possible to adopt various image forming mechanisms. The Embodiment shown in the figure illustrates an electrostatic image forming mechanism as the image forming section 3. However, the image forming section 3 is not limited to the electrostatic image forming mechanism shown in the figure, and it is also possible to adopt an inkjet image forming mechanism, offset image forming mechanism and the like.

The image forming section 3 shown in FIG. 1 is provided with a photosensitive body 9 (drum, belt), and a light emitting device 10 that emits an optical beam to the photosensitive body 9, and a developer 11 and cleaner (not shown) are disposed around the rotating photosensitive body 9. The section shown in the figure is a monochrome printing mechanism, where a latent image is optically formed on the photosensitive body 9 with the light emitting device 10, and toner ink is added to the latent image with the developer 11. The ink image (ink toner) added to the photosensitive body 9 is transferred to a sheet fed from the paper feed section 2 with a transfer charger 12, and the image-transferred sheet is fused with a fuse roller 13, and then, is fed to a sheet discharge path 14. In the sheet discharge path 14, a sheet discharge roller 15 is disposed, a sheet discharge opening 16 is formed in its end, and the sheet is transported to the sheet processing apparatus B described later from the sheet discharge opening 16 with the sheet discharge roller 15.

Above the thus configured image forming unit A1 is provided the image read unit A2 for reading an original document image, and further above the image read unit A2 is mounted the document feed unit A3.

The image read unit A2 is provided with first platen 17 and second platen 21 formed of transparent glass, read carriage 18, light source mounted on the read carriage 18, photoelectric converter 19, and reduction optical system 20 configured by combining mirrors and lenses, light from the light source is applied to an image of an original document sheet placed on the platen 17, by scanning the read carriage 18 along the platen 17, the reflected light from the image of the original document sheet is guided to the photoelectric converter 19 by the reduction optical system 20, and the image is read. The photoelectric converter 19 converts the image data into electric signals to transfer to the image forming section 3.

The document feed unit A3 is provided with a paper feed tray 22, paper feed path 23, and sheet discharge tray 24, transports the original document placed on the paper feed tray 22 along the paper feed path 23 on a sheet-by-sheet basis, passes on the second platen 21, and discharges to the sheet discharge tray 24. In addition, in reading the original document which is fed from the document feed unit A3 and passes on the second platen 21, the read carriage 18 is beforehand halted below the second platen 21, and image data is generated from the image passing on the second platen 21.

[Sheet Processing Apparatus]

The sheet processing apparatus B coupled to the image forming apparatus A is an apparatus for applying post-processing to an image-formed sheet discharged from the sheet discharge opening 16 of the image forming apparatus A, and has (1) function (printout mode) for stacking and storing a sheet discharged from the sheet discharge opening 16 without performing sheet processing, (2) function (jog sorting mode) for collating sheets discharged from the sheet discharge opening 16 in the shape of a bunch to stack and store, (3) function ("binding processing mode") for collating sheets discharged from the sheet discharge opening 16 in the shape of a bunch to perform binding processing, and then, stacking to store, and (4) function ("bookbinding finish processing mode") for collating sheets discharged from the sheet discharge opening 16 in the shape of a bunch, and then, folding in the shape of a book to stack and store. In addition, the sheet processing apparatus B does not need to have all the functions described above, and may have as appropriate corresponding to apparatus specifications (design specifications). Also in this case, it is assumed to minimally have the function (binding processing mode) of (3).

Figure 2:
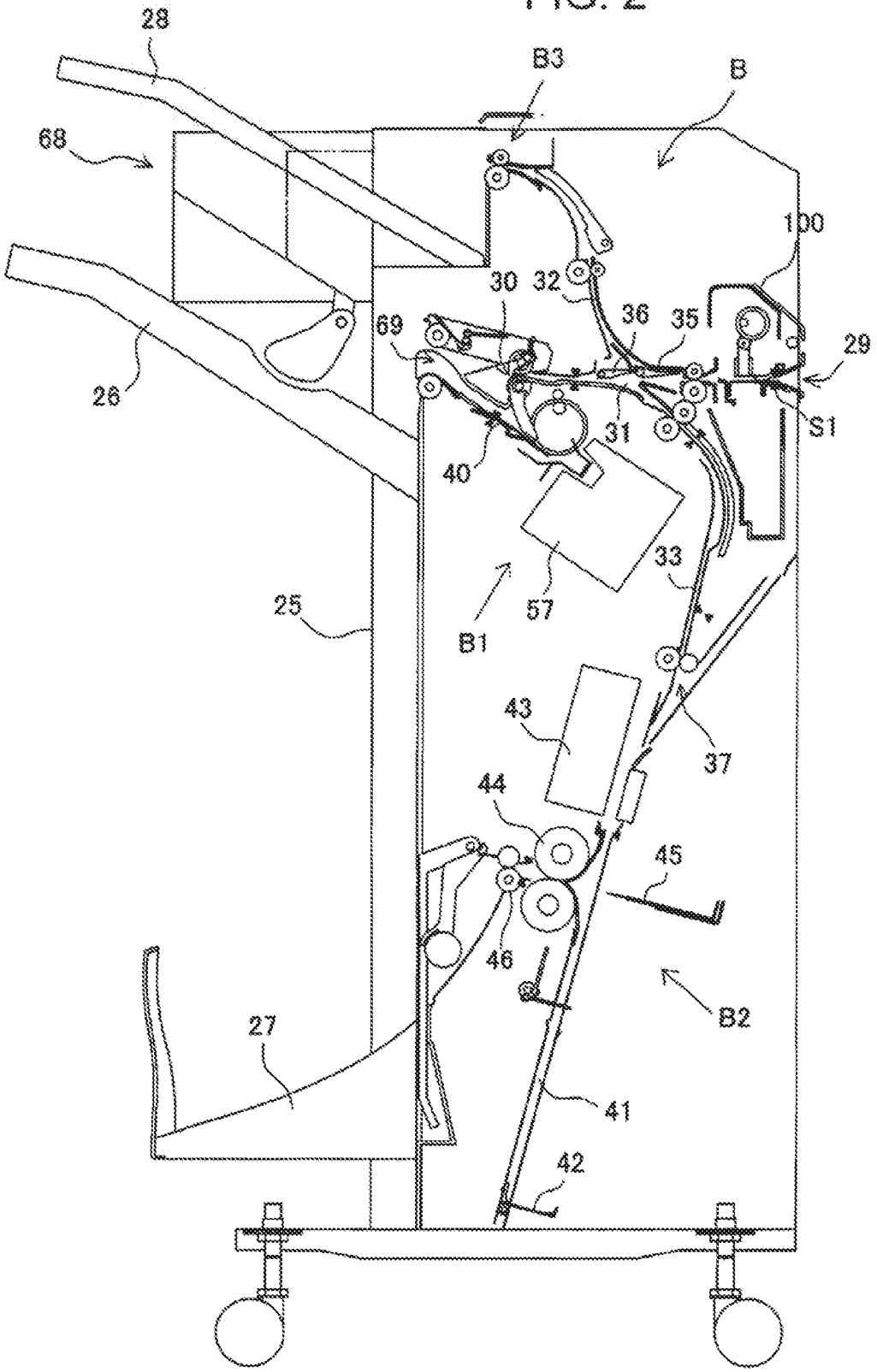
FIG. 2 is an explanatory view illustrating an internal configuration of the sheet processing apparatus shown in FIG. 1.

FIG. 2 illustrates a detailed configuration of the sheet processing apparatus B. The sheet processing apparatus B is provided with an apparatus housing 25, first stacking means 26, second stacking means 27 and third stacking means 28. Inside the apparatus housing 25 is provided a carry-in path 31 extending approximately linearly in the approximately horizontal direction between a carry-in opening 29 and a path sheet discharge opening 30. As shown in FIG. 1, the carry-in path 31 is disposed to continue to the sheet discharge opening 16 of the image forming apparatus A, is provided with a transport means for transporting a sheet discharged from the sheet discharge opening 16 in a predetermined transport direction, and is configured to be able to carry into the sheet processing apparatus B via the carry-in path 31. Further, inside the apparatus housing 25 are provided a third sheet discharge path 32, second sheet discharge path 33 and first sheet discharge path 34. The first sheet discharge path 34 is disposed on the downstream side from the carry-in path 31. Further, the third sheet discharge path 32 and second sheet discharge path 33 are disposed on the upstream side from the first sheet discharge path 34, and are configured to branch off from the carry-in path 31 in this order to the downstream side from the carry-in opening 29, and a first path switch piece 35 and second path switch piece 36 are provided in respective branch portions. Further, the first sheet discharge path 34 and second sheet discharge path 33 are switchback transport paths for transporting the sheet in the transport direction of the sheet that is the direction opposite to the carry-in path 31.

Further, inside the apparatus housing 25 are provided a first processing section B1, second processing section B2, and third processing section B3, and it is configured that a sheet carried in the carry-in path 31 from the carry-in opening 29 is subjected to post-processing in the first processing section B1, second processing section B2, or third processing section B3, and then, is stacked to store in the first stacking means 26, second stacking means 27 or third stacking means 28. In the Embodiment shown in the figure, the carry-in opening 29 of the carry-in path 31 is disposed to continue to the sheet discharge opening 16 of the image forming apparatus A, and it is configured that a sheet discharged from the sheet discharge opening 16 of the image forming apparatus A is carried in from the carry-in opening 29, and is discharged to the first stacking means 26 via the first processing section B1, the second stacking means 27 via the second processing section B2, or the third stacking means 28 via the third processing section B3.

The first processing section B1 is disposed on the downstream side of a path exit (path discharge opening 30) of the carry-in path 31, performs binding processing on a sheet bunch obtained by collating and collecting sequentially fed sheets, and then, stacks the bunch on the first stacking means 26 to store. However, without performing binding processing on a bunch of collated and collected sheets in the first processing section B1, sheets may be stacked and stored on the first stacking means 26, or may be subjected to only an offset in the width direction described later to collect and store on the first stacking means 26. The second processing section B2 is disposed in a path exit (sheet discharge opening) 37 of the second sheet discharge path 33 branched off from the carry-in path 31, and after collating and collecting sequentially fed sheets to perform binding processing, performs folding processing to stack and store on the second stacking means 27. The third processing section B3 is disposed on the downstream side of the third sheet discharge path 32 branched off from the carry-in path, applies an offset to the transport sheet by a predetermined amount in the direction (orthogonal direction in this Embodiment) crossing the transport direction of the sheet to sort, and then, stacks on the third stacking means 28 to store.

[Carry-in Path]

The carry-in path 31 is comprised of a linear path extending in the approximately horizontal direction between the carry-in opening 29 and the path sheet discharge opening 30. The carry-in path 31 is provided with a transport roller 38 for transporting a sheet toward the path sheet discharge opening 30 from the carry-in opening 29, and sheet discharge roller 39 (comprised of a sheet discharge roller 39*a* disposed above and a sheet discharge roller 39*b* disposed below) provided in the exit end of the carry-in path 31 to discharge the transported sheet from the path sheet discharge opening 30, and these rollers are driven by a forward/backward rotation-capable drive motor (not shown). Further, in the vicinity of the carry-in opening 29 and the path sheet discharge opening 30 of the carry-in path 31 are provided an entrance sensor S1 and exit sensor S2 for detecting a front end and/or rear end of the sheet, respectively. The transport roller 38 may be provided in a plurality of portions along the carry-in path 31.

To the above-mentioned carry-in path 31 are coupled the first sheet discharge path 34 and second sheet discharge path 33 so as to allocate and carry the sheet carried in from the carry-in opening 29 to the first processing section B1 and the second processing section B2, the second processing section B2 is coupled to the upstream side in the path sheet discharge direction via the second sheet discharge path 33, and the first processing section B1 is coupled to the downstream side via the first sheet discharge path 34. The second sheet discharge path 33 is coupled to the carry-in path 31 so as to branch off from the carry-in path 31, and guides the sheet from the carry-in opening 29 to the second processing section B2 disposed on the downstream side thereof, and the first sheet discharge path 34 is coupled to the downstream side of the path sheet discharge opening 30 of the carry-in path 31, and guides the sheet from the carry-in opening 29 to the first processing section B1 disposed on the downstream side thereof. In the carry-in path 31, the third sheet discharge path 32 for guiding a sheet, which does not undergo post-processing in the first processing section B1 and the second processing section B2, to the third stacking means 28 is coupled to the upstream side of the branch portion to the second sheet discharge path in the path sheet discharge direction, and the third processing section B3 is coupled via the third sheet discharge path 32. The third processing section B3 performs jog sorting for offsetting the transport sheet in the direction orthogonal to the sheet discharge direction to sort, and the jog-sorted sheet is stacked and stored on the third stacking means 28.

The first path switch piece 35 and second path switch piece 36 are further provided respectively in branch portions from the carry-in path 31 to the third sheet discharge path 32 and the second sheet discharge path 33, and are driven by actuation means (not shown) such as a solenoid. It is selected, by the first path switch piece 35, whether to guide the sheet carried in from the carry-in opening 29 to the third sheet discharge path 32, or to the first sheet discharge path 34 or the second sheet discharge path 33, and it is selected, by the second path switch piece 36, whether to guide the sheet fed from the carry-in opening 29 to the second processing section B2, or to the first processing section B1 on the downstream side thereof.

Further, on the carry-in path 30 is provided a post-processing unit 100 for performing post-processing such as stamping (stamping means) and punching (punching means) on a sheet. In the Embodiment shown in the figure, the post-processing unit 100 is disposed in the vicinity of the carry-in opening 29 of the carry-in path 31 to be attachable/detachable corresponding to apparatus specifications.

[First Processing Section]

The first processing section B1 is provided with a collecting means disposed on the downstream side of the carry-in path 31 to collect sheets fed from the path sheet discharge opening 30 to form a bunch of sheets, and is provided with a processing tray 40 for collating and collecting, and a binding processing mechanism for performing binding processing on a bunch of collected sheets. As shown in FIG. 2, the processing tray 40 is provided below the path sheet discharge opening 30 of the carry-in path 31 via a height difference, and between the path sheet discharge opening 30 and the processing tray 40 is formed the first sheet discharge path 34 for reversing the transport direction from the path discharge opening 30 and guiding the sheet onto the processing tray 40.

Above the first sheet discharge path 34 is provided a sheet carry-in mechanism for carrying a sheet fed from the path sheet discharge opening 30 on the processing tray 40, and the processing tray 40 is provided with a positioning mechanism to position the sheet in a predetermined binding position, and a bunch transport means for carrying out a sheet bunch subjected to the binding processing to the first stacking means 26 on the downstream side. The sheet carry-in mechanism, positioning mechanism, and bunch transport means will be described later. In addition, in the Embodiment shown in the figure, the processing tray 40 bridge-supports the sheet fed from the path sheet discharge opening 30 with the first stacking means 26 disposed on the downstream side. In other words, in the sheet fed from the path sheet discharge opening 30, the front end portion thereof is supported on the uppermost sheet stacked on the first stacking means 26 on the downstream side, while the rear end portion is supported on the processing tray 40, and the sheet is supported to lie astride the first stacking means 26 and the processing tray 40.

[Second Processing Section]

The second sheet discharge path 33 is coupled to the carry-in path 31 so as to branch off from the carry-in path 31 on the upstream side of the first sheet discharge path 34, and is configured to guide the sheet carried in from the carry-in opening 29 to the second processing section B2 via the second sheet discharge path 33. The second processing section B2 collates sheets fed from the carry-in path 31 to collect, performs the binding processing in a center portion, and then, performs inward folding processing (hereinafter, described as "bookbinding finish"). The bookbinding finished-sheet bunch is stacked and stored on the second stacking means 27 disposed on the downstream side of the second processing section B2.

The second processing section B2 is provided with a guide member 41 for collecting sheets in the shape of a bunch, a regulation stopper 42 for positioning the sheet in a predetermined position on the guide member 41, a saddle stitch staple unit 43 for performing the binding processing (saddle stitch processing) in the center portion of sheets positioned by the regulation stopper 42, and a folding processing mechanism for folding the sheet bunch in the center portion after the saddle stitch processing.

As disclosed in Japanese Patent Application Publication No. 2008-184324, Japanese Patent Application Publication No. 2009-051644 and the like, the saddle stitch staple unit 43 adopts the mechanism for performing the saddle stitch processing, by shifting in position along the sheet center portion in a state of nipping the sheet bunch with a head unit and an anvil unit. Further, as shown in FIG. 2, the folding processing mechanism adopts a configuration for inserting the sheet bunch in a folding roller pair 44 in mutually press-contact by a folding blade 45, and folding by rolling of the folding roller pair 44. Such a mechanism is also disclosed in Japanese Patent Application Publication No. 2008-184324, Japanese Patent Application Publication No. 2009-051644 and the like.

The second stacking means 27 is disposed on the downstream side of the second processing section B2, and it is configured that the sheet bunch folded in the shape of a book is sent out by a sheet discharge roller 46, and is stacked and stored on the second stacking means 27. The second stacking means 27 is disposed below the first stacking means 26 in the side face in the sheet discharge direction of the apparatus housing 25.

[Third Processing Section]

The third sheet discharge path 32 is coupled to the carry-in path 31 so as to branch off from the carry-in path 31 on the upstream side from the second sheet discharge path 33, and is configured to guide a sheet carried in from the carry-in opening 29 to the third processing section B3 via the third sheet discharge path 32. The third processing section B3 is provided with a roller shift mechanism (not shown) for offsetting the sheet fed from the carry-in path 31 by a predetermined amount in the direction orthogonal to the transport direction, and the sheet transported in the third sheet discharge path 32 is offset to a position in the direction orthogonal to the transport direction of the sheet so as to sort for each copy, and is stacked and stored on the third stacking means 28 of the third processing section B3. Various mechanisms are known as such a jog sorting mechanism, and therefore, detailed descriptions thereof are omitted herein. In addition, the sheet stacked on the third stacking means 28 may be offset in the direction orthogonal to the transport direction during transport in the carry-in path 31 or the third sheet discharge path 32.

[Manual Set Section]

Figure 4:
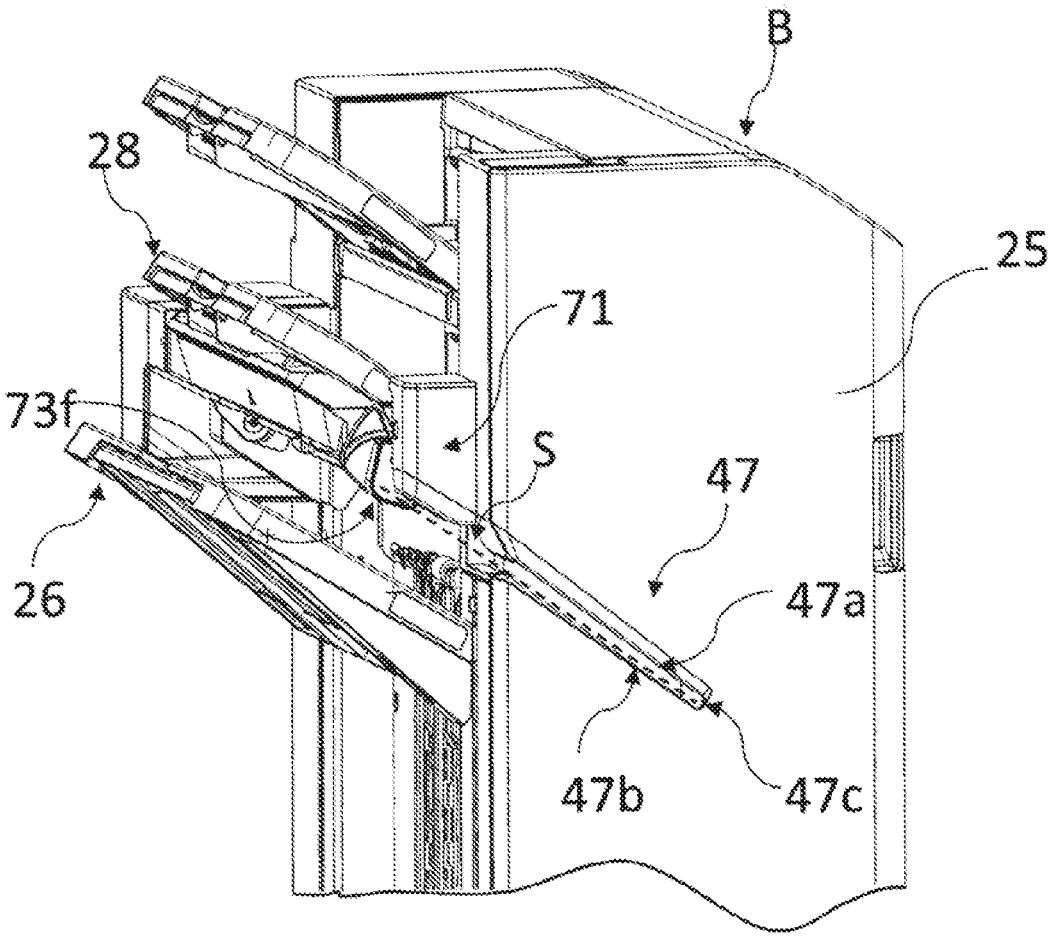
FIG. 4 is a perspective view of a manual set section in the sheet processing apparatus shown in FIG. 1.

The apparatus housing 25 is provided with a manual set section 47 for inserting and setting a sheet bunch created outside to perform the binding processing. The manual set section 47 is used, for example, when an operator collates a bunch of original document sheets with images read to perform the binding processing, and is equipped with a mechanism for performing the binding processing on the sheet bunch set by the operator with an incorporated binding processing apparatus 57. Specifically, as shown in FIG. 4, the manual set section 47 is comprised of a slit-shaped opening 47*a*, sheet support surface 47*b*, and regulation surface 47*c*, and is configured so that a sheet bunch S is inserted in the slit-shaped opening 47*a* from the outside, and that the binding processing is performed on the sheet bunch S supported on the sheet support surface 47*b* with the binding processing apparatus 57 disposed inside the apparatus. In the Embodiment shown in the figure, the support surface 47*b* is disposed in a position adjacent to a paper mount surface 40*a* of the processing tray 40 in the same plane. This is because of shifting a staple unit 57*a* capable of shifting along an end edge of the processing tray 40 described later to the sheet support surface 47*b* provided in the position adjacent to the processing tray 40 to be able to perform the binding processing on the sheet bunch set on the sheet support surface 47*b* by the operator.

The sheet bunch S manually inserted from the slit-shaped opening 47*a* is inserted into a binding position along the sheet support surface 47*b*, and the end face is struck and regulated by the regulation surface 47*c*. By this means, in the sheet bunch S inserted from the outside, the undersurface thereof is supported by the sheet support surface 47*b*, while the end face thereof is struck and regulated by the regulation surface 47*c*, and the sheet bunch S is positioned in a predetermined binding position. Subsequently, the binding processing is performed on the sheet bunch S with the staple unit 57*a* shifted to the binding position.

A configuration of the first processing section B1 will be described next in detail.

[Details of the First Processing Section (Collecting Means)]

Figure 3:
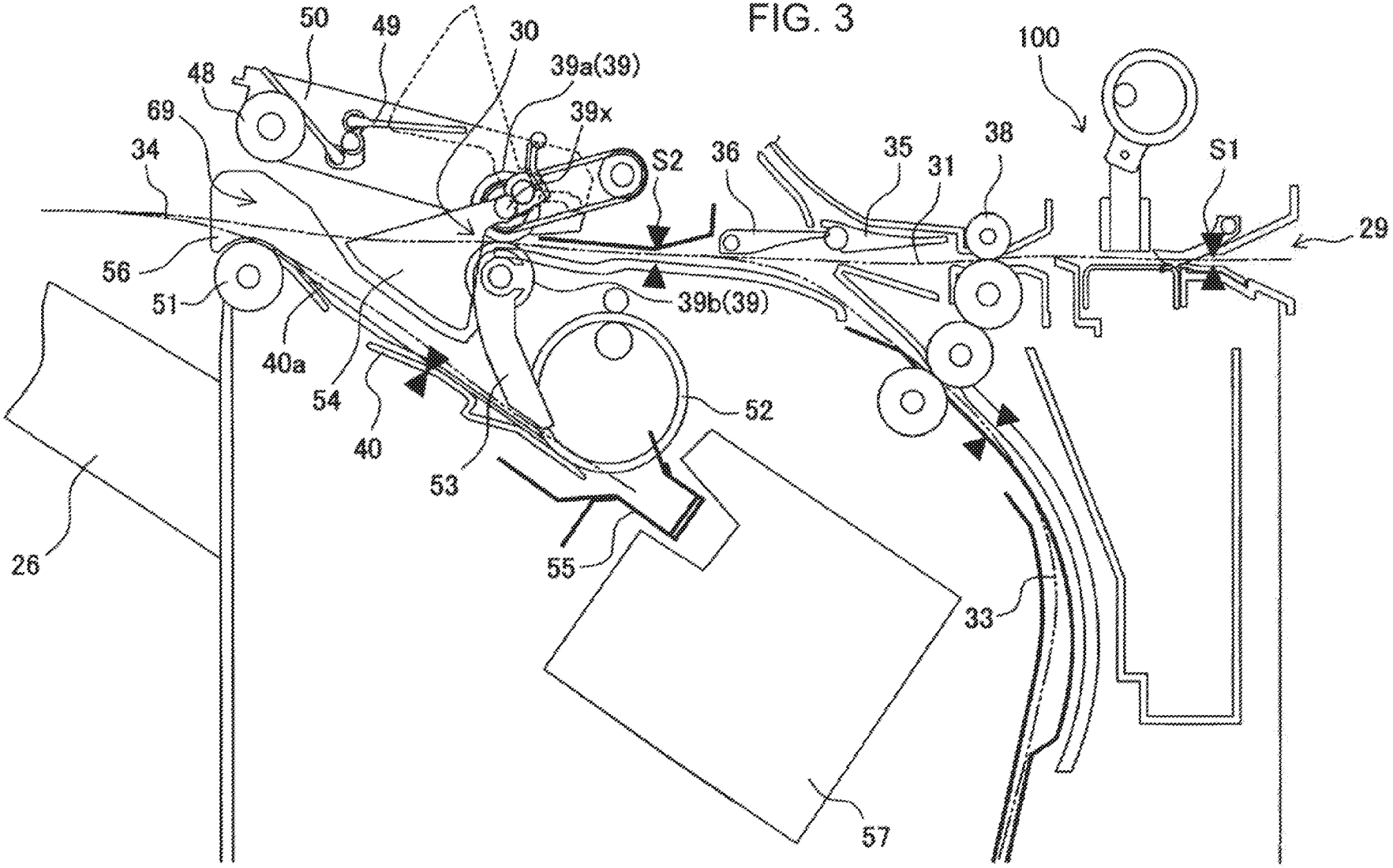
FIG. 3 is an enlarged view illustrating a path principal part of the sheet processing apparatus shown in FIG. 1.

As shown in FIG. 3, as the sheet carry-in mechanism, between the path sheet discharge opening 30 and the processing tray 40 are disposed a reverse transport mechanism for performing switchback transport in the direction opposite to the discharge direction of the sheet discharged from the path sheet discharge opening 30, a guide mechanism for guiding the sheet to the processing tray 40 side, and a take-in rotating body 52 for guiding the sheet to a regulation member 55.

The reverse transport mechanism is comprised of an up-and-down roller 48 which moves up and down between an operation position for engaging in a sheet carried onto the processing tray 40 and a waiting position for separating from the sheet, and a paddle rotating body 49 for carrying the sheet in the direction opposite to the sheet discharge direction, and the up-and-down roller 48 and paddle rotating body 49 are attached to a swing bracket 50.

The swing bracket 50 is disposed in an apparatus frame to be swingable on a rotation shaft 39*x* (in the Embodiment shown in the figure, rotation shaft of the sheet discharge roller 39*a*) as the center, and rotation shafts of the up-and-down roller 48 and paddle rotating body 49 are bearing-supported by the swing bracket 50. An up-and-down motor not shown is coupled to the swing bracket 50 to move up and down the supported up-and-down roller 48 and paddle rotating body 49 between the operation position for engaging in the sheet on the processing tray 40 and the waiting position for separating from the sheet on the processing tray 40.

Further, a drive motor not shown is coupled to the up-and-down roller 48 and paddle rotating body 49, and drive is conveyed so that the up-and-down roller 48 rotates in both directions of the clockwise direction and the counterclockwise direction in FIG. 3 (the direction for feeding the sheet into the processing tray 40 and the direction for feeding the sheet out of the processing tray 40), and that the paddle rotating body 49 rotates in the counterclockwise direction in FIG. 3 (the direction for feeding the sheet into the processing tray 40). Further, the processing tray 40 is provided with a driven roller 51 coming into mutually press-contact with the up-and-down roller 48, and the up-and-down roller 48 and the driven roller 51 nip a sheet or a sheet bunch to transport to the downstream side.

On the processing tray 40, the take-in rotating body 52 is further provided as the sheet carry-in mechanism for carrying a sheet in the processing tray 40. In this Embodiment, the take-in rotating body 52 is comprised of a ring-shaped or short cylindrical belt member disposed rotatably above the processing tray 40. The take-in rotating body 52 engages in a top surface of a sheet newly transported on the sheet in an uppermost position of a sheet bunch collected on the processing tray 40, rotates in the counterclockwise direction shown in the figure, while pressing a front end of the sheet, and feeds the sheet into until the sheet comes into contact with the regulation member 55 described later. By this means, it is possible to resolve a curl and skew capable of occurring during transport on the processing tray 40 up to contact with the regulation member 55.

Further, a sheet pressing member 53 is provided above the processing tray 40. The sheet pressing member 53 is a plate-shaped member, a front end thereof is disposed to be positioned on opposite sides in the rotation shaft line direction of the take-in rotating body 52, and the member 53 is attached to the rotation shaft of the sheet discharge roller 39*b* to be swingable by its own weight. Accordingly, the sheet pressing member 53 swings in the counterclockwise direction, as the number of stacked sheets on the processing tray 40 increases.

A guide mechanism is provided between the up-and-down roller 48 and the take-in rotating body 52 to guide the sheet carried onto the processing tray 40 toward the regulation member 55. In the Embodiment shown in the figure, the guide mechanism is comprised of a sheet guide member 54 which moves up and down between a position shown by the dotted lines and a position shown by the solid line in FIG. 3. The sheet guide member 54 retracts to the position shown by the dotted lines when a sheet is discharged from the path sheet discharge opening 30, and after a rear end of the discharged sheet passes through the path sheet discharge opening 30, moves down to the position shown by the solid line to guide the sheet onto the processing tray 40.

The processing tray 40 has the paper mount surface 40*a*, is provided with the regulation member 55 for striking and regulating the front end portion (end portion on the right side in the figure) of the sheet carried in the processing tray 40 and a pair of side edge alignment plates 56 (56F, 56R) (alignment section) for coming into contact with opposite side edges in the width direction (direction orthogonal to the carry-in and discharge directions) of the sheet to position in a position of reference (center reference, one-side side reference), as a positioning mechanism for positioning a sheet in a predetermined position on the paper mount surface 40*a*, and is further provided with the binding processing apparatus 57 for performing the binding processing on a sheet bunch stacked on the paper mount surface 40*a*.

Figure 5A:
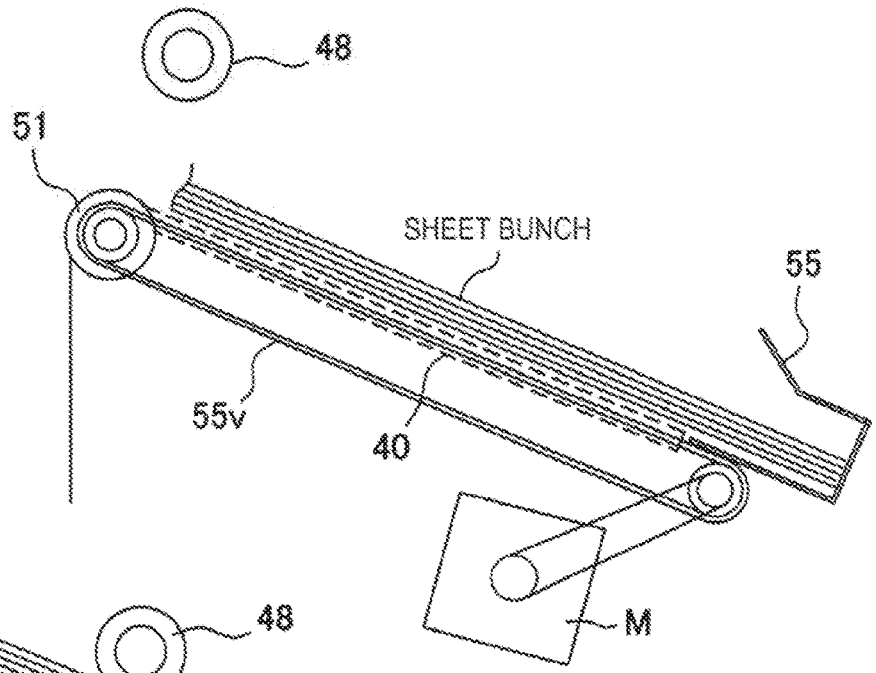
FIGS. 5A to 5C contain explanatory views of operation of a bunch transport means, where
Figure 5B:
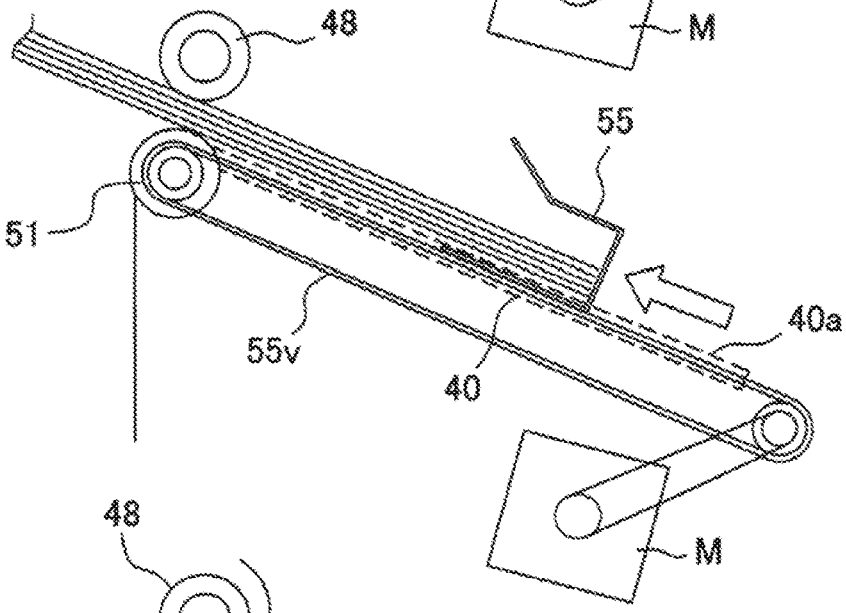
Figure 5C:
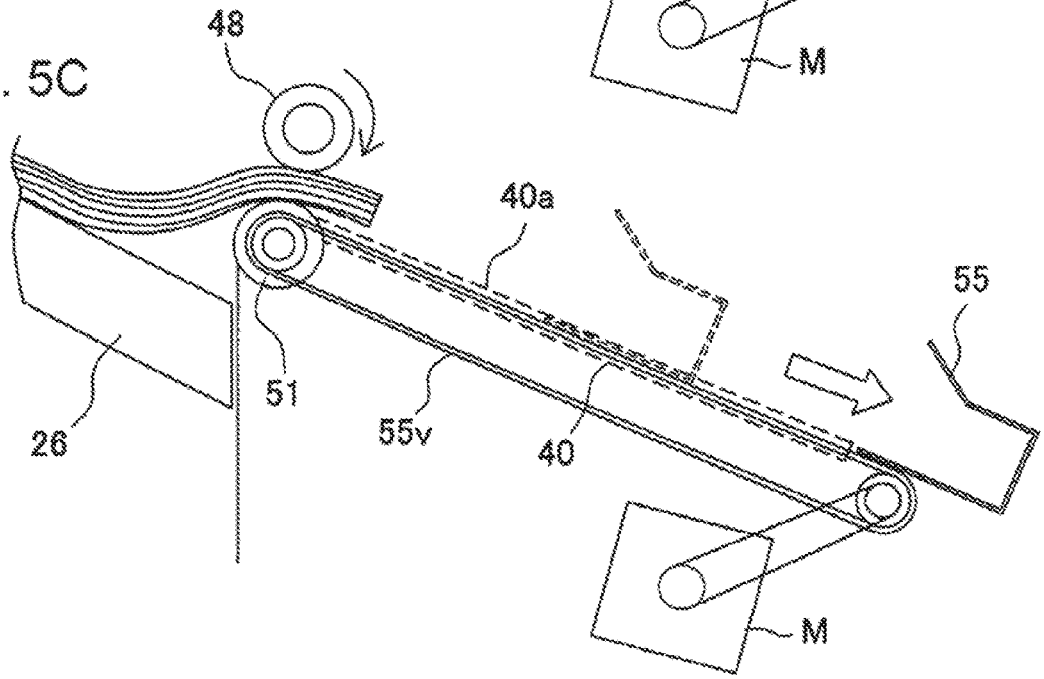

The regulation member 55 is configured to be able to reciprocate in the sheet discharge direction along the processing tray 40, so as to perform the function of carrying out the sheet bunch subjected to the binding processing toward the first stacking means 26 disposed on the downstream side of the processing tray 40. In other words, the regulation member 55 functions as the bunch transport means. In the Embodiment shown in the figure, a mechanism for causing the regulation member 55 to reciprocate is comprised of a conveyor belt 55*v* with the regulation member 55 attached thereto, and a drive motor M for driving the conveyor belt 55*v*, as shown in FIGS. 5A to 5C.

Figure 6:
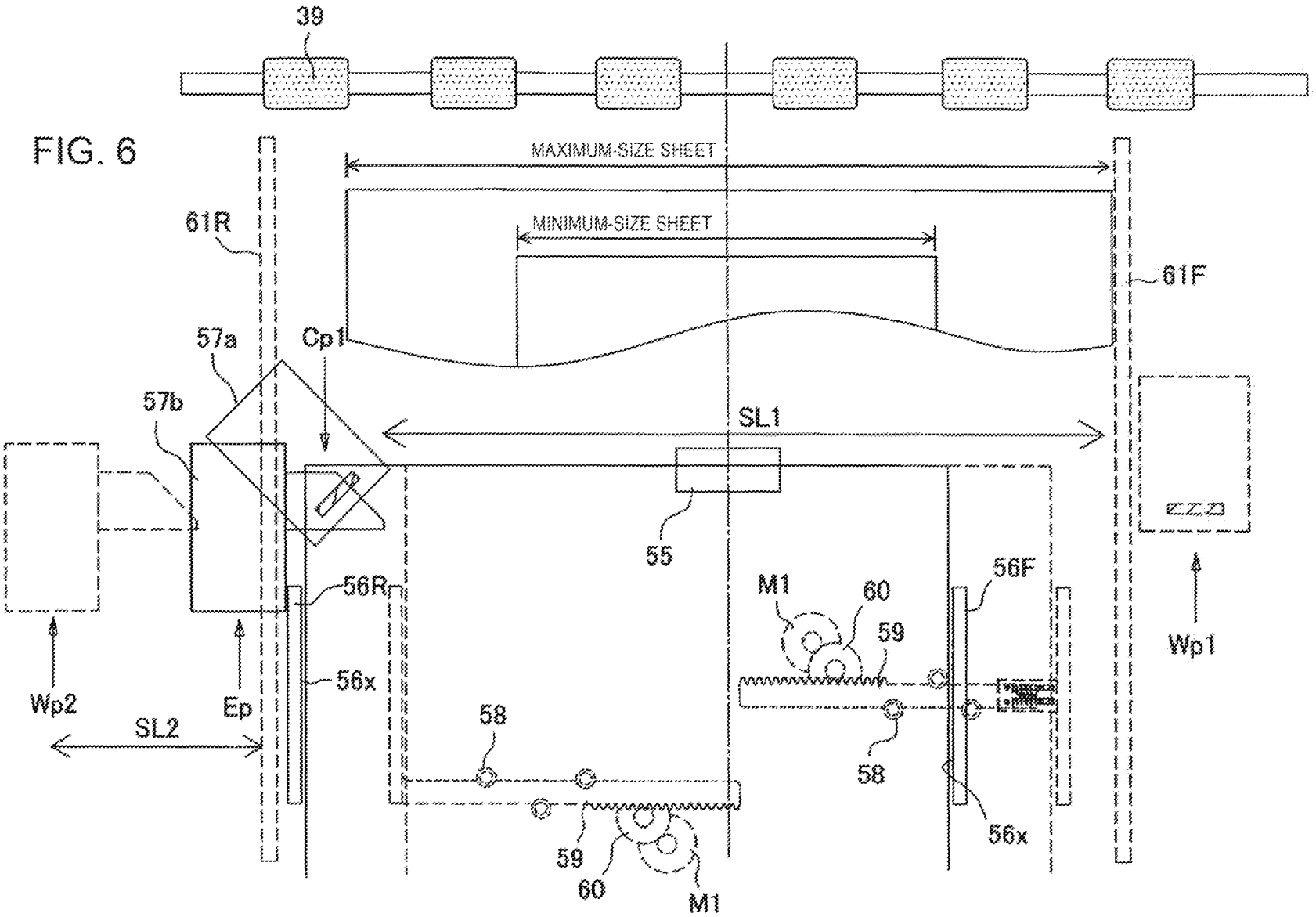
FIG. 6 is an explanatory view illustrating an arrangement relationship between alignment positions and a staple unit in the sheet processing apparatus shown in FIG. 1.

As shown in FIG. 6, the side edge alignment plate 56F disposed on the apparatus front side (side facing an operator) and side edge alignment plate 56R disposed on the apparatus rear side (farther side from the operator) have respective regulation surfaces 56*x* for engaging in side edges of the sheet, and are disposed so that the respective regulation surfaces 56*x* are opposed to each other. Such a pair of side edge alignment plates 56 is disposed in the processing tray 40 to be able to reciprocate in a predetermined stroke. The stroke of the side edge alignment plates 56 is set corresponding to a difference in size between the maximum-size sheet and the minimum-size sheet, and an offset amount for position-shifting (offset-transporting) the sheet bunch subsequent to alignment in the width direction (direction orthogonal to the carry-in direction and discharge direction). In addition, an offset shift of the side edge alignment plates 56F, 56R is to shift sheets stacked in the center reference in corner binding to the right side in right corner binding, or to the left side in left corner binding, by a predetermined amount. In the jog sorting mode, except the lowest paper of a first bunch that is discharged when there is no sheet in the first stacking means described later, a bunch offset is performed after carrying a sheet in the processing tray 40 to create a bunch and aligning, and this offset shift may adopt one of a scheme for executing on a sheet-by-sheet basis whenever a sheet is carried in the processing tray 40, and a scheme for shifting for each bunch to perform the binding processing after aligning sheets in the shape of a bunch. In addition, penetrating slit grooves (not shown) are provided in the processing tray 40, and are disposed so that the side edge alignment plates 56F, 56R having the regulation surfaces 56*x* for engaging in sheet side edges penetrate the slit grooves, and protrude from the paper mount surface 40*a* of the processing tray 40 to extend.

Each of the side edge alignment plates 56F, 56R is formed integrally with a rack 59 supported slidably by a plurality of guide rollers 58 (which may be a rail member) on the back side (side opposite to the paper mount surface 40*a*) of the processing tray 40. Each rack 59 is coupled to an alignment motor M1 via a pinion 60. For example, the alignment motor M1 is comprised of a stepping motor, and is configured so as to detect a position of each of the side edge alignment plates 56F, 56R with a position sensor not shown, and using the detection value as the reference, enable each of the side edge alignment plates 56F, 56R to shift in the width direction by a designated shift amount. In addition, it is also possible to adopt mechanisms except the rack-pinion mechanism shown in the figure, for example, such as a mechanism where the side edge alignment plates 56F, 56R are fixed to a timing belt, and the timing belt is caused to reciprocate by a motor via a pulley.

The side edge alignment plates 56 of such a configuration wait in predetermined waiting positions (positions of the width of a sheet+$\alpha$) based on sheet size information provided from the image forming apparatus A and the like, and in "multi-binding", start alignment operation at timing at which the sheet is carried onto the processing tray 40, and the sheet end strikes the regulation member 55. In alignment operation in this case, a pair of side edge alignment plates 56F, 56R move in directions (directions in which a pair of side edge alignment plates approach each other) opposite to each other by the same amount. By this means, the sheet carried in the processing tray 40 is positioned with the sheet center as the reference. By repeating such carry-in operation and alignment operation of the sheet, sheets are collated and stacked on the processing tray 40 in the shape of a bunch. At this point, sheets of different sizes are positioned in the center reference. Also in "corner binding" and the jog sorting mode, similarly, the plates start alignment operation at timing at which the sheet is carried onto the processing tray 40, and the sheet end strikes the regulation member 55. In alignment operation in this case, shift amounts are made different between the side edge alignment plate 56F or 56R on the binding position side, and the side edge alignment plate 56R or 56F on the side opposite to the binding position, and the shift amount is set so that the sheet corner is positioned in the beforehand determined binding position.

Figure 7:
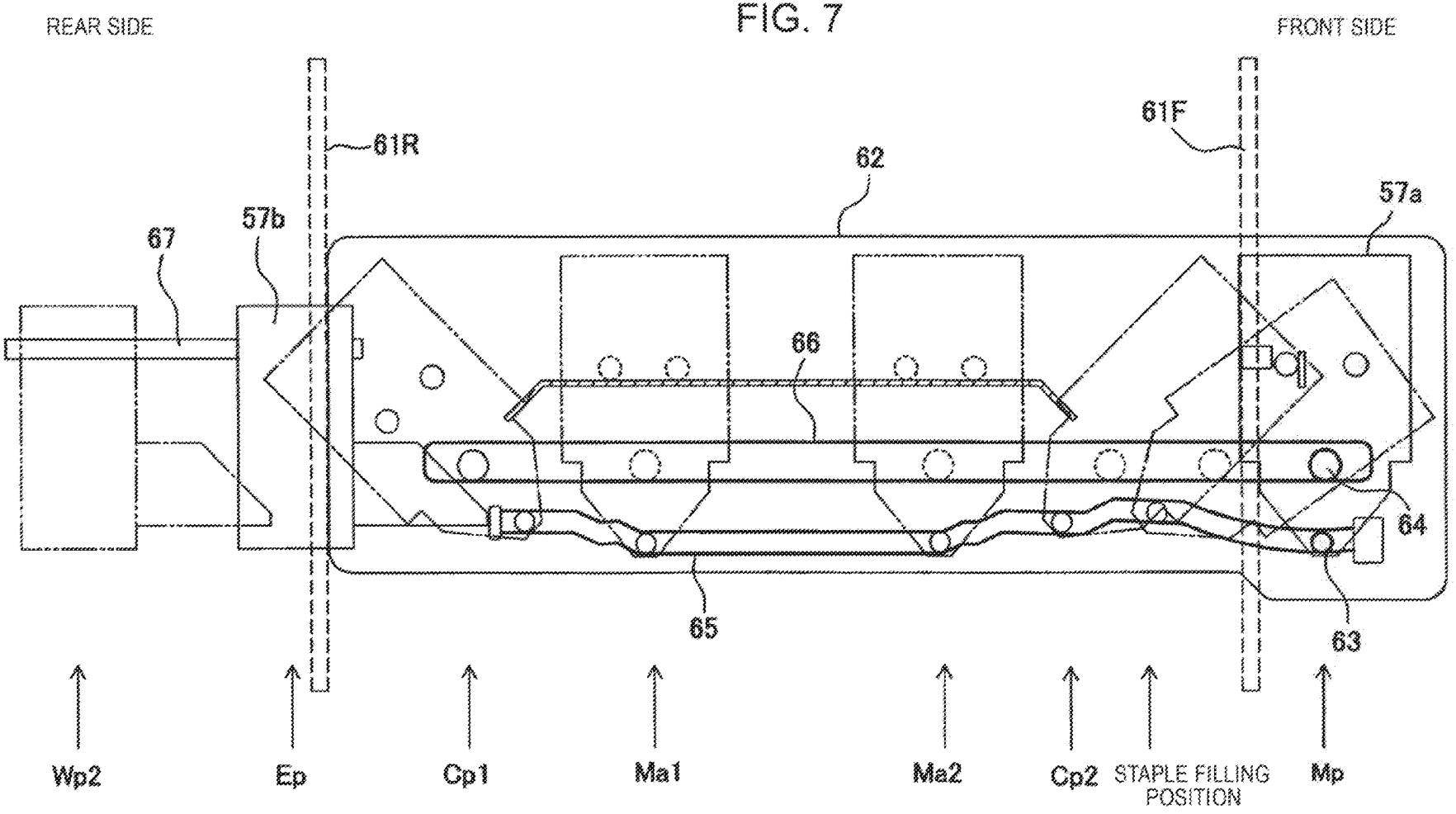
FIG. 7 is an explanatory view illustrating shift loci of the staple unit and eco-binding unit in the sheet processing apparatus shown in FIG. 1.

As shown in FIGS. 6 and 7, the binding processing apparatus 57 is comprised of the first binding processing unit (hereinafter, described as the staple unit) 57*a* for staple-binding a sheet bunch with a staple, and a second binding processing unit (hereinafter, described as an eco-binding unit) 57*b* for binding without a staple, and is configured to be disposed in a binding position selectively. As shown in FIG. 7, the staple unit 57*a* and eco-binding unit 57*b* are capable of shifting along the end portion of the processing tray 40 on the regulation member 55 side. Structures of the staple unit 57*a* for performing staple-binding and eco-binding unit 57*b* for performing non-staple-binding are publicly known, and are not limited particularly, and therefore, detailed descriptions thereof are omitted herein.

Herein, referring to FIGS. 6 and 7, descriptions will be given to the relationship between each binding position and the alignment position, and shift to each binding position of the staple unit 57*a* and eco-binding unit 57*b*.

In this Embodiment, as shown in FIG. 7, set are "multi-binding positions Mal, Mat" to perform the binding processing in a plurality of portions of a sheet bunch with staples by the staple unit 57*a*, "corner binding positions Cp1, Cp2" to perform bunch binding processing in a corner of a sheet bunch by the staple unit 57*a*, "manual binding position Mp" to perform the binding processing on a manually set sheet bunch by the staple unit 57*a*, "eco-binding position Ep" to perform non-staple-binding in a corner of a sheet bunch by the eco-binding unit 57*b*, a waiting position Wp1 of the staple unit 57*a*, and a waiting position Wp2 of the eco-binding unit 57*b*.

In the multi-binding processing, the binding processing is performed on the end edge of the sheet bunch, which is positioned and aligned by the regulation member 55 and a pair of side edge alignment plates 56 on the processing tray 40, by the staple unit 57*a*, and as binding positions of two portions, the binding positions Mal, Mat are set along the end edge of the paper mount surface 40*a*. In the Embodiment shown in the figure, the binding processing is performed in two portions of the side edge, but the binding processing may be performed in three or more portions. In the corner binding processing, the binding processing is performed in a right corner or a left corner of the sheet bunch collected and aligned on the processing tray 40 by the staple unit 57*a*, and set are the right corner binding position Cp1 to perform the binding processing in the right corner, and the left corner binding position Cp2 to perform the binding processing in the left corner. In manual binding processing, the binding processing is performed on the sheet bunch supported on the sheet support surface 47*b* of the manual set section 47 by the staple unit 57*a*, and in the Embodiment shown in the figure, the manual binding position Mp is set in a region on the apparatus front side. In eco-binding processing, the binding processing is performed in a corner of a side edge portion of the sheet bunch collected and aligned on the processing tray 40 by the eco-binding unit 57*b*, and in the Embodiment shown in the figure, the eco-binding position Ep is set in a region on the apparatus rear end.

The staple unit 57*a* is provided with a first rolling roller 63 and second rolling roller 64, the first rolling roller 63 and second rolling roller 64 are respectively engaged in a first travel rail 65 and second travel rail 66 formed in an apparatus frame 62 fixed to side frames 61F, 61R, while penetrating an opening portion (not shown) provided in the side frame 61F on the apparatus front side, and it is thereby configured that the staple unit 57*a* is capable of shifting between the waiting position Wp1 and the corner binding position Cp1 in a stroke SL1 along the first travel rail 65 and second travel rail 66. Further, the eco-binding unit 57*b* is capable of shifting between the waiting position Wp2 and the eco-binding position Ep in a stoke SL2 along a guide rod 67 disposed in the apparatus frame (not shown).

[Neat Alignment Apparatus]

The sheet processing apparatus B is further provided with a neat alignment apparatus 68 to align sheets on the stacking means. In the Embodiment shown in the figure, the neat alignment apparatus 68 is disposed between the first stacking means 26 and the third stacking means 28, and aligns the sheet bunch, which passes through a discharge opening 69 formed between the up-and-down roller 48 and the driven roller 51 (discharge means) and is discharged onto the first stacking means 26 from the processing tray 40, in a beforehand determined position. In addition, since the paper mount surface 40*a* of the processing tray 40 and the sheet support surface 47*b* of the manual set section 47 are formed to be positioned in the same plane, the discharge opening 69 is positioned to be adjacent to, in the width direction (direction orthogonal to the discharge direction of the sheet), a manual feed opening 70 formed on the side face of the apparatus housing 25 by the slit-shaped opening 47*a* of the manual set section 47.

A detailed structure of the neat alignment apparatus 68 will be described below, using FIG. 8 and FIGS. 13 to 16. In the following description, "front side" means the side on which the manual set section 47 is provided in the apparatus housing 25, and "rear side" means the side opposite to the front side in the sheet width direction orthogonal to the sheet discharge direction.

The neat alignment apparatus 68 is provided with a neat housing 71 comprised of an inclined cover (in the present application, referred to as an "exterior" as appropriate), frame and the like, an alignment means capable of shifting within a predetermined movable region to align a sheet in the width direction orthogonal to the discharge direction of the sheet discharged from the discharge opening 69, an alignment plate rotation shaft member 72 supported by the neat housing 71 rotatably to extend in the width direction, a pair of neat alignment plates 73 (73F, 73R) supported by the alignment plate rotation shaft member 72, a paddle apparatus 74 supported by the alignment plate rotation shaft member 72, and a neat control circuit 75 stored inside the neat housing 71. The neat housing 71 is attached above the discharge opening 69 on the side face of the apparatus housing 25 in the sheet discharge direction. Further, the neat housing 71 has a mechanism storage portion 71*b* and control circuit storage portion 71*c* partitioned by a partition wall 71*a*, and the neat control circuit 75 is stored in the control circuit storage portion 71*c*. In the alignment plate rotation shaft member 72, one end portion is supported by the partition wall 71*a*, and the other end portion is supported by a shaft support portion 71*d* rotatably.

A pair of neat alignment plates 73 is supported to be able to shift along the alignment plate rotation shaft member 72 and to rotate around the alignment plate rotation shaft member 72, is driven to shift along the alignment plate rotation shaft member 72 by a shaft-direction drive mechanism 76, and is rotated around the alignment plate rotation shaft member 72 between retract positions and operation positions by a rotation drive mechanism 77. In addition, operation of the shaft-direction drive mechanism 76 and rotation drive mechanism 77 is controlled by a neat alignment control section comprised of the neat control circuit 75, instead of a post-processing control section 81 of the sheet processing apparatus B described later.

Figure 13:
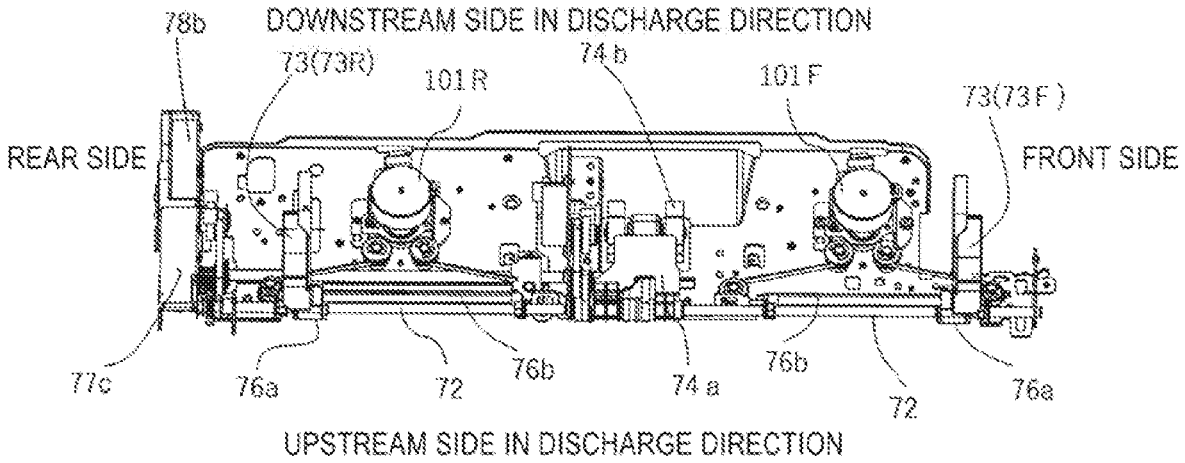
FIG. 13 is an explanatory view illustrating a configuration of the neat alignment apparatus.
Figure 14:
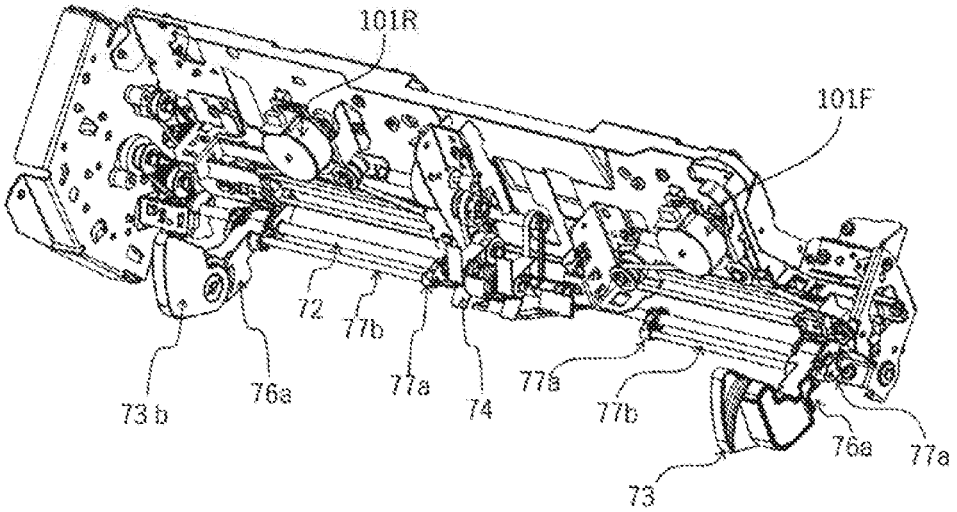
FIG. 14 is an explanatory view illustrating the configuration of the neat alignment apparatus viewed from a slanting direction.

In this Embodiment, as shown in FIG. 13 illustrating an internal configuration of the neat alignment apparatus 68 from below and FIG. 14 illustrating the configuration from above diagonally, the shaft-direction drive mechanism 76 to shift each neat alignment plate 73 along the alignment plate rotation shaft member 72 is comprised of a shift block 76*a* which each neat alignment plate 73 is attached to and which is supported by the alignment plate rotation shaft member 72 slidably along the alignment plate rotation shaft member 72, shaft-direction drive sources (101F, 101R) disposed inside the mechanism storage portion 71*b* of the neat housing 71, and a drive belt 76*b* which the shift block 76*a* is fixed to and which shifts in the neat shaft direction by the shaft-direction drive sources, where the shift block 76*a* is guided and shifts along the alignment plate rotation shaft member 72 in association with a shift of the drive belt 76*b* by the shaft-direction drive sources 101F, 101R, and the mechanism 76 thereby shifts the neat alignment plate 73 along the alignment plate rotation shaft member 72. Further, stepping motors are used in the shaft-direction drive sources 101F, 101R, each of the sources is disposed to be positioned on the downstream side of the alignment plate rotation shaft member 72 in the discharge direction and is mounted in space on the inner side of an inclined face forming portion of the neat housing described later, and it is thereby possible to make the neat housing thin and small in the height direction.

A pair of neat alignment plates 73 that is the alignment means shifts from receive preparation positions where the pair of alignment plates 73 are disposed at an interval wider than a width of a sheet bunch discharged from the discharge opening 69, to alignment positions in directions of approaching each other along the alignment plate rotation shaft member 72 by the shaft-direction drive mechanism 76, strikes side edges in the width direction (direction orthogonal to the discharge direction of the sheet) so as to nip the sheets to be placed on the first stacking means 26, and thereby aligns the sheet bunch in the beforehand determined position on the first stacking means 26. The receive preparation positions of the pair of neat alignment plates 73 in the sheet width direction may be set at positions capable of receiving a length in the width direction of the maximum sheet discharged from the discharge opening 69, or may be controlled to be adjusted to suitable positions corresponding to a length in the width direction of a discharged sheet.

Further, in this Embodiment, the rotation drive mechanism 77 to rotate each neat alignment plate 73 around the alignment plate rotation shaft member 72 is comprised of a pair of fixed blocks 77*a*, 77*a* fixed to the alignment plate rotation shaft member 72 to be incapable of rotating, a parallel shaft member 77*b* which extends between the pair of fixed blocks 77*a*, 77*a* parallel with the alignment plate rotation shaft member 72, while penetrating the shift block 76*a*, and a rotation motor 77*c* that drives rotation of the alignment plate rotation shaft member 72. The rotation motor 77*c* is stored inside the control circuit storage portion 71*c* in a state of fixing to the partition wall 71*a* of the neat housing 71. When the alignment plate rotation shaft member 72 is rotated by the rotation motor 77*c*, the pair of fixed blocks 77*a* rotates on the alignment plate rotation shaft member 72, and the parallel shaft member 77*b* supported between the fixed blocks 77*a*, 77*a* rotates around the alignment plate rotation shaft member 72. By this means, the shift block 76*a* which the parallel shaft member 77*b* penetrates rotates on the alignment plate rotation shaft member 72, and it is possible to rotate the neat alignment plate 73 attached to the shift bock 76*a* around the alignment plate rotation shaft member 72. However, the configuration of the rotation drive mechanism 77 is not limited, as long as the mechanism enables the pair of neat alignment plates 73 to rotate around the alignment plate rotation shaft member 72, and it is also possible to adopt other configurations.

The pair of neat alignment plates 73 is rotated from retract positions, which are separated and positioned from/above the sheet bunch placed on the first stacking means 26, toward the first stacking means 26 around the alignment plate rotation shaft member 72 by the rotation drive mechanism 77, moves down to height positions (operation positions) of the side edges in the width direction of the sheet bunch placed on the first stacking means 26, and is thereby capable of coming into contact with the side edges in the width direction of the sheet bunch placed on the first stacking means 26 to perform alignment operation.

In addition, since the shift block 76*a* with each neat alignment plate 73 attached thereto is disposed between the pair of fixed blocks 77*a*, 77*b* on the alignment plate rotation shaft member 72, a movable range of the neat alignment plate 73 along the alignment plate rotation shaft member 72 is regulated by arrangement positions and interval of the pair of fixed blocks 77*a*, 77*a*. Accordingly, the positions of the pair of fixed blocks 77*a*, 77*a* are set, in consideration of the maximum width and minimum width of sheet bunches discharged from the discharge opening 69 and the beforehand determined alignment position on the first stacking means 26. For example, in the case of the setting for offsetting the sheet bunch discharged from the discharge opening 69 to the front side or the rear side by a predetermined amount by the pair of near alignment plates 73F, 73R, in the neat alignment plate 73R on the rear side, the rear-side limit position is set to be able to shift to the rear side farther than the rear-side edge of the sheet bunch of the maximum width in offsetting to the rear side, and the front-side limit position is set to be able to shift to a position of the rear-side edge of the sheet bunch of the minimum width in offsetting to the front side. Further, in the neat alignment plate 73F on the front side, the front-side limit position is set to be able to shift to the farther front side, exceeding a position of the front-side end edge of the sheet bunch of the maximum width in offsetting to the front side, and the rear-side limit position is set to be able to shift to a position of the side edge on the front side of the sheet bunch of the minimum width in offsetting to the rear side.

While meeting the above-mentioned conditions, it is preferable that the front-side limit position of the neat alignment plate 73F on the front side is set so that the front-side neat alignment plate 73F disposed in the front-side limit position does not block the manual feed opening 70 i.e. the movable range of the neat alignment plate 73 is set to be on the discharge opening side rather than the manual feed opening 70. By thus setting the front-side limit position and movable range of the neat alignment plate 73F on the front side, it is possible to prevent the neat alignment plate 73 from interfering with insertion of a sheet bunch into the manual feed opening 70. Moreover, it is further preferable that the front-side limit position of the neat alignment plate 73F on the front side is set so that the surface on the front side of the front-side neat alignment plate 73F disposed in the front-side limit position is disposed in the rear-side end edge of the manual feed opening 70 to function as a guide to the manual feed opening 70.

In addition, in this Embodiment, the case is described where the pair of fixed blocks 77*a* functions as a regulation section to limit the movable range of the neat alignment plate 73, but as a different Embodiment, the movable range and front-side limit position may be controlled by a control means, and it is also possible to set the movable range and front-side limit position, using the number of clocks and operation time of the stepping motor used in the shaft-direction drive mechanism 76, and rotation pulse signals by an encoder.

The paddle apparatus 74 is comprised of a paddle support member 74*a* supported by the alignment plate rotation shaft member 72 rotatably, a wing-shaped paddle member 74*b* which is comprised of an elastic material and is supported by the paddle support member 74*a* rotatably, a paddle rotation drive mechanism 78 for rotation-driving the paddle member 74*b*, and a paddle up-and-down mechanism 79 for rotating the paddle member 74*b* around the alignment plate rotation shaft member 72 to move up and down.

The paddle apparatus 74 is disposed between the shaft-direction drive source 101F for shifting the front-side alignment plate and the shaft-direction drive source 101R for shifting the rear-side alignment plate, disposed inside the mechanism storage portion 71*b* of the neat housing 71. By this means, it is possible to reduce the thickness of the neat housing 71. Further, by the paddle up-and-down mechanism 79, the paddle apparatus 74 rotates around the alignment plate rotation shaft member 72 between the operation position shown by the solid line in FIG. 8 for enabling the paddle member 74*b* to contact the sheet bunch discharged from the discharge opening 69 and the waiting position shown by the dotted lines in FIG. 8, positioned above the operation position, where the paddle member 74*b* is unable to contact the sheet bunch discharged from the discharge opening 69.

In this Embodiment, the paddle rotation drive mechanism 78 to drive rotation of the paddle member 74*b* is comprised of a paddle drive shaft 78*a* supported rotatably inside the neat housing 71, a paddle rotation drive motor 79 which is stored inside the control circuit storage portion 71*c* in a state of being fixed to the partition wall 71*a* of the neat housing 71 and which drives rotation of the paddle drive shaft 78*a*, and an intermediate rotating body 78*c* supported by the alignment plate rotation shaft member 72 rotatably, conveys rotation between the paddle drive shaft 78*a* and the intermediate rotating body 78*c* and between the intermediate rotating body 78*c* and the paddle member 74*b* via belts 78*d*, 78*e*, and thereby rotates the paddle member 74*b*. However, the configuration of the paddle rotation drive mechanism 78 is not limited, as long as the mechanism is capable of rotating the paddle member 74*b*, and it is also possible to adopt other configurations.

Figure 8:
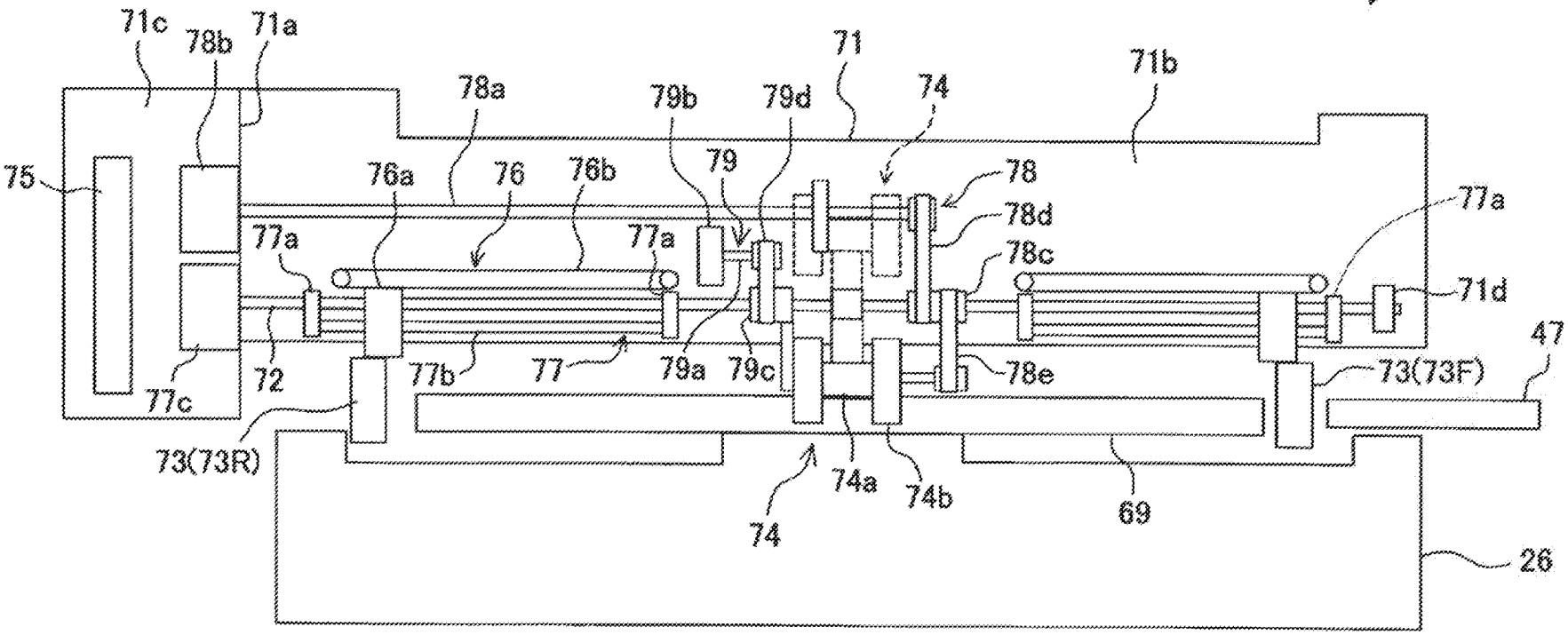
FIG. 8 is an explanatory view illustrating a structure of a neat alignment apparatus of the sheet processing apparatus shown in FIG. 1.
Figure 15:
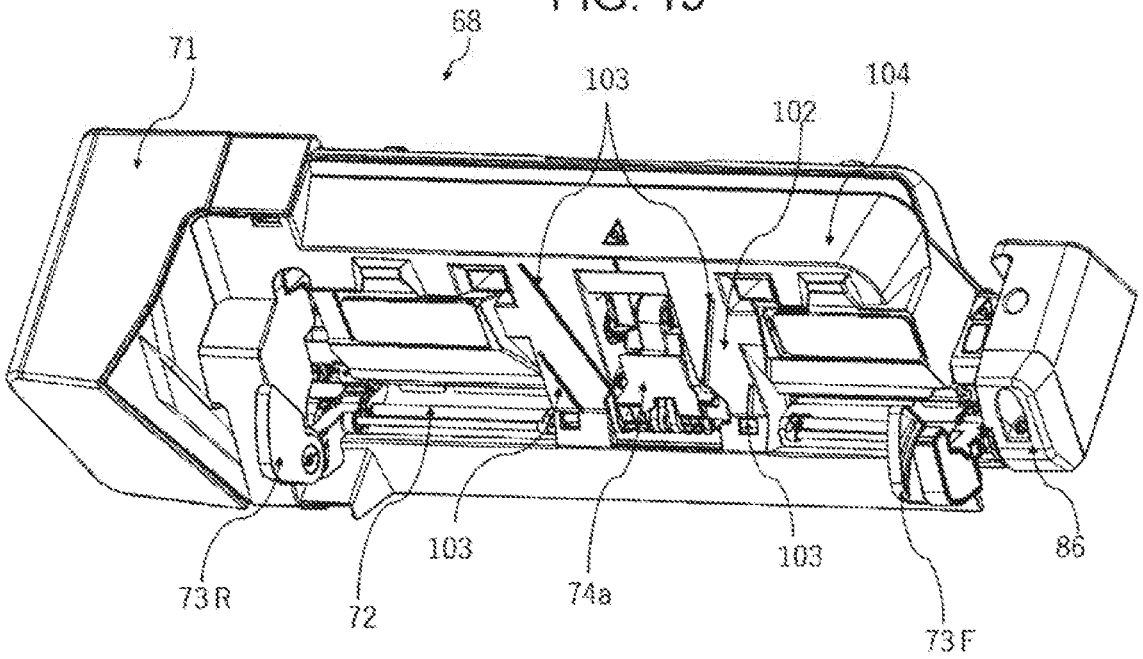
FIG. 15 is an explanatory view illustrating a configuration of an inclined cover (exterior) of the neat alignment apparatus.

Further, as shown in FIGS. 8, 13 and 15, in this Embodiment, the paddle up-and-down mechanism 79 to rotate the paddle member 74*b* around the alignment plate rotation shaft member 72 is comprised of a paddle swing shaft 79*a* supported by the neat housing 71 rotatably, a paddle swing drive motor 79*b* for rotating the paddle swing shaft 79*a*, and an intermediate swing body 79*c* which is supported by the alignment plate rotation shaft member 72 rotatably and is coupled to the paddle support member 74, conveys rotation between the paddle swing shaft 79*a* and the intermediate swing body 79*c* via a belt 79*d*, thereby rotates the intermediate swing member 79*c* around the alignment plate rotation shaft member 72, and rotates the paddle support member 74*a* coupled to the intermediate swing body 79*c* around the alignment plate rotation shaft member 72. In association with rotation of the paddle support member 74*a*, the paddle member 74*b* supported rotatably by the paddle support member 74*a* between the waiting position and the operation position is swung around the alignment plate rotation shaft member 72 between the waiting position and the operation position. However, the configuration of the paddle up-and-down mechanism 79 is not limited, as long as the mechanism is capable of moving the paddle member 74*b* up and down, and it is also possible to adopt other configurations.

When the sheet bunch is discharged from the discharge opening 69, the paddle apparatus 74 moves down from the waiting position to the operation position to rotate the paddle member, thereby scrapes off the sheet bunch discharged from the discharge opening 69 toward the first stacking means 26 disposed below the discharge opening 69 with the paddle member 74*b*, and performs the function of reliably placing on the first stacking means 26.

Further, the paddle support member 74*a* supported by the alignment plate rotation shaft member 72 rotatably is stored to be substantially the same plane for forming a part of the inclined face forming portion of the neat housing, and it is also possible to use the backside of the paddle support member 74*b* as a paper feeding face.

The first stacking means 26 moves the tray (stack face) downward so as to maintain a certain height difference from the discharge opening 69, as stacked sheets increase, and the downward speed of the first stacking means 26 is made different between when the neat alignment member described previously is not used and when the member is used. Specifically, in the case where a mode for using the neat alignment member is selected and sheets exceeding the predetermined number of sheets are stacked on the first stacking means 26, the speed is reduced from normal 30 mm/Sec to 23 mm/Sec. The neat alignment member 73 is capable of performing alignment operation reliably by maintaining the height position for contacting the sheet at a predetermined height, however, in the case of stacking many sheets, the load of the motor increases by weight of the sheets. Therefore, it is an object to prevent alignment from being an insufficient state caused by that the tray moves down by a larger amount than an intentional amount by moment of inertia in moving the first stacking means 26.

[Neat Housing]

Figure 16:
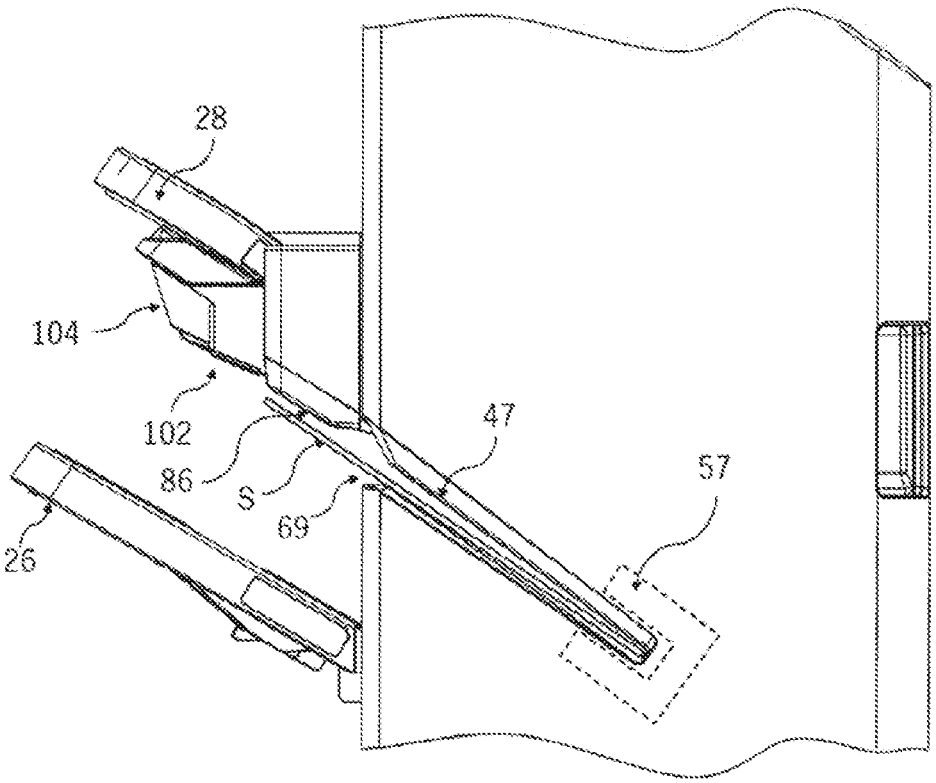
FIG. 16 is an explanatory view illustrating a position relationship between sheets inserted in the manual set section and the neat housing.

As shown in FIG. 16, in order to align the sheet on the first stacking means 26, it is necessary that the neat housing 71 is positioned above the discharge opening 69. The first stacking means 26 is provided with the inclined stack face having a predetermined inclined angle so that the downstream side in the transport direction is higher than the upstream side, and further, since the third stacking means is disposed above the inclined stack face, a distance between the first stacking means and the third stacking means is slight. Therefore, in order not to interfere with removal of sheets stacked on the first stacking means, the neat housing 71 is configured in consideration of easy removal.

In this Embodiment, the neat housing 71 is positioned in a position opposed to the backside of the third stacking means i.e. inclined stack face. Then, in order to maximize the number of stacked sheets of the first stacking means 26, an exterior inclined face (inclined face of the inclined cover)

102 provided with an inclined angle (inclined angle 30° from the horizontal surface) almost parallel with the first stacking means 26 is formed, and the inclined face is also used as the paper feeding face (configuration for guiding the sheet). Further, as shown in FIG. 15, in the exterior inclined face 102, radial ribs 103 are provided along the discharge direction of the sheet to prevent the sheet from being caught in paper feeding, the face from being transport resistance by occurrence of significant friction, and the like, and an edge-line portion of the lower face of the neat alignment plate 73 is also configured to reduce transport resistance as the rib in storing the neat alignment plate 73.

Further, in addition thereto, the angle of the lower face of the neat housing is set in accordance with the other configuration. By providing a taper face 104 with an inclined angle (inclined angle 72° from the horizontal surface) larger than those of the first stacking means and exterior inclined face 102 on the downstream side of the exterior inclined face 102 in the sheet transport direction, the size of a width is reserved when an operator removes sheets, and it is possible to improve ease of sheet removal. Furthermore, a different inclined angle is set for a neat housing front cover 86 positioned above the manual set section 47 described later.

[Control Configuration]

Figure 9:
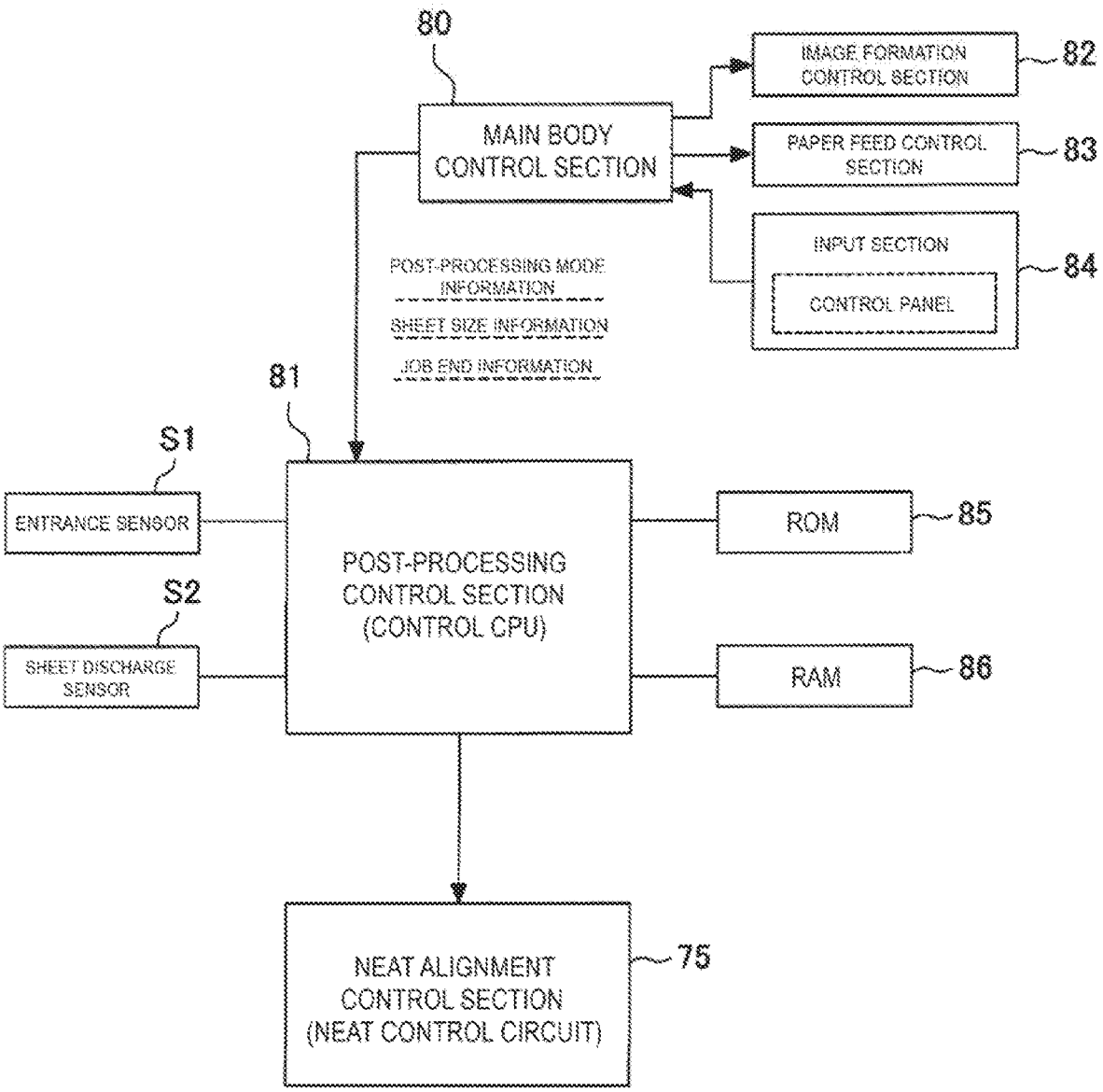
FIG. 9 is a block diagram illustrating a control configuration of the image forming system shown in FIG. 1.

Referring to FIG. 9, descriptions will be given to a control configuration of the image forming system shown in FIG. 1. The image forming system is provided with a control section (hereinafter, described as "main body control section") 80 of the image forming apparatus A, and a control section (hereinafter, described as "post-processing control section") 81 of the sheet processing apparatus B. The main body control section 80 includes an image formation control section 82, paper feed control section 83, and input section (control panel) 84.

Settings of "image formation mode" and "post-processing mode" are made from the control panel 84. The image formation mode is to make mode settings of color • monochrome printing, two-side • one side printing and the like, and to set image formation conditions of sheet size, sheet paper quality, the number of printout copies, scaling printing and the like. Further, for example, the "post-processing mode" is set for "printout mode", "staple binding processing mode" and "eco-binding processing mode" that are types of "binding processing mode", "bookbinding finish processing mode", "jog sorting mode" or the like. In addition, the image forming apparatus A shown in the figure is provided with "manual binding mode", and when this mode is selected, binding processing operation of a sheet bunch is executed offline independently of the main body control section 80 of the image forming apparatus A. The image formation control section 82 controls operation of the image forming section 3, and the paper feed control section 83 controls operation of feeding paper from the paper feed section 2 to the image forming section 3.

Further, the main body control section 80 transmits data of the selected post-processing mode information, the number of sheets, number-of-copy information, paper thickness information of sheets undergoing image formation, and the like to the post-processing control section 81. Furthermore, the main body control section 80 transmits a job end signal to the post-processing control section 81 whenever image formation is finished.

The above-mentioned post-processing mode will be described in detail. When the above-mentioned "printout mode" is selected, a sheet from the path sheet discharge opening 30 is stacked and stored on the first stacking means 26 via the processing tray 40, without performing the binding processing. In this case, sheets are stacked and collected on the processing tray 40, and a bunch of collected sheets is discharged to the first stacking means 26 with a jog end signal from the main body control section 80. Further, it is also possible to offset in the width direction via the third processing section B3 to perform jog sorting, and discharge to the third stacking means 28.

The "staple binding processing mode" is to collect sheets discharged from the path sheet discharge opening 30 on the processing tray 40 to collate, perform staple-binding on a bunch of collated sheets, and then, stack on the first stacking means 26 to store. In this case, in principle, sheets of the same paper thickness and the same size are designated as sheets undergoing image formation by an operator. In this staple binding processing mode, one of "multi-binding", "right corner binding" and "left corner binding" is selected and designated. Each binding position is as described previously.

The "jog sorting mode" is to sort sheets with images formed in the image forming apparatus A into groups to offset and collect, and groups to collect without offsetting, and the offset sheet bunch and the non-offset sheet bunch are stacked alternately on the first stacking means 26. In the jog sorting, a sheet discharged onto the processing tray 40 is discharged onto the first stacking means 26 in a state where the sheet is offset to a position in the width direction by a predetermined amount by the alignment plate 56 on the processing tray.

When the setting is made such that whether or not the neat alignment apparatus 68 is used or that a high alignment property mode is selected, alignment operation with the neat alignment apparatus 68 is performed on sheets to stack on the first stacking means 26. Operation of the neat alignment apparatus 68 will be described below.

Operation of the neat alignment apparatus will be described in the case of aligning a sheet discharged from the discharge opening 69 in the center reference position by the neat alignment apparatus 68. In the printout mode described previously, a sheet transported from the image forming apparatus is transported to the discharge opening 69 without placing on the processing tray 40, and when alignment and offset in the sheet width direction is performed, the sheet is discharged toward the first stacking means 26. Prior to discharge of the sheet from the discharge opening 69 to the first stacking means 26, the neat control circuit 75 receives the position setting information and sheet size information of the sheet discharged from the discharge opening 69 from the post-processing control section 81, and moves down the pair of neat alignment plates 73 from the retract positions to the first stacking means 26 by the rotation drive mechanism 77, while shifting the pair of neat alignment plates 73, along the alignment plate rotation shaft member 72, to the receive preparation positions disposed at the interval of sheet width+α with the center in the width direction of the sheet or sheet bunch discharged from the discharge opening 69 as the reference. At the same time, the neat control circuit 75 moves down the paddle apparatus 74 from the waiting position to the operation position by the paddle up-and-down mechanism 79, and rotates the paddle member 74*b* by the paddle rotation drive mechanism 78. Further, when the sheet discharged from the discharge opening 69 is scraped off to the first stacking means 26 by the paddle member 74*b* and is placed on the first stacking means 26, the neat control circuit 75 shifts the pair of neat alignment plates 73 to the alignment positions in the direction of approaching each other by the shaft-direction drive mechanism 76 to strike the side edges in the width direction of the sheet or sheet bunch, and aligns the sheet or sheet bunch in a predetermined position. When alignment operation is completed, the neat alignment plate 73 is returned to the retract position to receive the next sheet by the rotation drive mechanism 77, and the paddle apparatus 74 is also moved up to the waiting position. Thus, alignment operation is performed on the first stacking means 26.

The neat control circuit 75 controls a drive velocity of each drive mechanism to operate the neat alignment plates 73. A stepping motor is used for the rotation drive mechanism 77 for shifting the neat alignment plate 73 between the retract position and the alignment position, and in moving the neat alignment plate 73 down from the retract position to the alignment position, the mechanism is operated by self-activation of the stepping motor. By this means, the neat alignment plate 73 is prevented from moving down too much by moment of inertia not to contact the tray and sheet strongly, to be able to align in an intentional alignment height. Conversely, in shifting from the alignment position to the retract position, by accelerating the motor, it is intended that the plate retracts promptly not to interfere with discharge of the next sheet. In operation in the sheet width direction by the shaft-direction drive mechanism 76, similarly, the operation is controlled so that a shift from the alignment position to the receive preparation position is faster than a shift from the receive preparation position to the alignment position not to interfere with discharge of the next sheet.

Operation of the neat alignment apparatus will be described in the case of aligning a jog sorting sheet discharged from the discharge opening 69 by the neat alignment apparatus 68. In the jog sorting mode described previously, with respect to sheets transported from the image forming apparatus, the predetermined number of sheets is placed on the processing tray 40, and is discharged from the discharge opening 69 in a state in which the position in the sheet width direction is shifted (jog-sorted) by the alignment plates 56F, 56R on the processing tray 40. In this jog sorting operation, after collecting the predetermined number of sheets discharged to the center position on the processing tray 40, the so-called bunch shift operation is performed to nip the sheets by the alignment plates 56F and 56R to shift the bunch.

In order to enhance positioning accuracy in the neat alignment apparatus described later, a shift amount in the bunch shift is to shift slightly larger, in addition to a distance to shift in jog sorting. By this means, by moving the neat alignment plate 73 in the direction opposite to the direction for shifting a sheet bunch discharge from the processing tray 40 to the first stacking means 26 in jog sorting, it is possible to strike and position in a state in which an alignment reference side (alignment plate on the rear side in shifting to the front side, or on the front side in shifting to the rear side) is fixed, and it is thereby possible to more enhance the alignment property.

In the above-mentioned jog sorting operation, the bunch shift operation is performed by the alignment plates 56F, 56R on the processing tray 40, and a sheet may be collected in a state of shifting on a sheet-by-sheet basis whenever the sheet is discharged onto the processing tray 40 to discharge to the first stacking means 26. Further, after discharging the predetermined number of sheets of a bunch to the first stacking means 26, the bunch shift may be performed by nipping with the neat alignment plates 73.

In addition, although it is also possible to shift using the neat alignment plates 73 whenever a single sheet is discharged onto the first stacking means 26, since there is a possibility that the alignment property deteriorates in the sheet bunch, it is possible to expect a higher alignment property in performing the bunch shift on the processing tray 40. Further, the lowest sheet of a first bunch discharged onto the first stacking means 26 is not limited thereto, and the alignment property is excellent in shifting after discharging onto the first stacking means 26. This is associated with that friction between the sheet stack face (resin) of the first stacking means 26 is larger than friction between sheets. Usually, a sheet discharged onto the first stacking means 26 hits the standing face existing on the upstream side in the sheet transport direction along the slope of the stack face to be positioned. However, with respect to the sheet in contact with the stack face of the first stacking means 26 i.e. the lowest sheet of the sheet bunch which is first discharged in a state of no sheet in the first stacking means, friction is large with weight of the bunch added, and there is a possibility that the sheet does not return to the standing face. In order to prevent the situation, with respect to the lowest sheet of the first bunch discharged onto to the first stacking means 26, the bunch is divided into a single or the low number of sheets to discharge, and is shifted to a sorting position by the neat alignment plates 73, and it is thereby possible to improve the alignment property.

In the jog sorting operation using the neat alignment apparatus, usually, a bunch of a first copy is shifted to the rear side or the front side from the discharge center line by 10 mm, the next bunch is shifted in the direction opposite to the bunch of the first copy by 10 mm, a total shift amount of 20 mm is thereby ensured, and operation is different between operation for particularly shifting the bunch of the first copy and operation for shifting bunches of second and subsequent copies.

FIGS. 17A to 18G are views illustrating the above-mentioned operation sequentially. Using the figures, descriptions will be given to jog sorting operation of the first copy, particularly, operation without a sheet existing on the first stacking tray. When a first sheet S1 of the first copy is discharged onto the processing tray 40 of the sheet processing apparatus B from the image forming apparatus A (FIG. 17A), the sheet is discharged to the first stacking means 26, without performing alignment operation and jog operation with the side edge alignment plates 56 provided on the processing tray (FIG. 17B). Subsequently, the sheet S1 is offset to the rear side by 10 mm with the neat alignment plates 73, and parallel therewith, remaining sheets of the first copy are collected on the processing tray from the image forming apparatus main body (FIG. 17C). A sheet bunch T1 formed of the discharged remaining sheets is aligned in the center by the side edge alignment plates 56 (FIG. 17D). The residual sheet bunch T1 aligned in the center is shifted to the front side by 15 mm with the side edge alignment plates 56. At this point, the neat alignment plate 73R is retracted to the rear side at least by 5 mm or more from the position in which S1 is aligned (FIG. 18E). Next, the T1 is discharged from the processing tray 40 to the first stacking means 26 (FIG. 18F). By shifting the neat alignment plate 73R to a shift completion position, the T1 is shifted to the R front side by 5 mm, and the T1 and S1 overlap with each other in the same position (FIG. 18G). By this means, the offset of the sheet bunch of the first copy is completed. With respect to sheets of second and subsequent copies, after collecting the required number of sheets on the processing tray 40, the shift direction in the width direction is switched between the rear side and the front side, and the sheets are offset by 15 mm, are discharged to the first stacking means, and are returned by 5 mm with the neat alignment plates. By repeating this operation, bunches offset by 10 mm are sequentially stacked. By performing such operation, the configuration is made excellent in the alignment property of the first bunch. However, in the case where already stacked sheets exist on the tray, and in the case of mode setting without importance being placed on the alignment property, the first bunch may also be offset by 15 mm on the processing tray 40, and returned by 5 mm on the first stacking tray.

In the alignment operation by the neat alignment plates 73, it is possible to further enhance the alignment property by varying the operation with types and properties of sheets. Particularly, in the case of sheets with air impermeability of the sheet of a predetermined value or more (sheets with longer time taken, than the predetermined time, for a certain amount of air to pass through a certain area of the sheet when certain pressure is applied) specifically, coat paper, art paper, recycled paper, sheets subjected to image formation exceeding a predetermined printing rate and the like with air permeance of 6000 Sec or more (<measurement method: JIS-P8117> Gurley method), particularly, an air layer is apt to occur between the sheet and the stack face, and after discharging the sheet, there is a tendency that it takes longer time that the lower surface of the sheet completely falls to the top face of stacked sheets. Further, in also sheets exceeding a predetermined size, sheets with low stiffness, and strongly curled sheets (particularly, with upward curl in the rear end portion in the transport direction), it takes much time to completely fall to the stack face. Therefore, in the same alignment time as in normal sheets, there is the risk that alignment displacement occurs after retracting the neat alignment plates 73. Accordingly, with respect to the sheet with air permeance higher than the predetermined value, by increasing the time for halting the neat alignment plate 73 to press in the alignment position from normal 60 ms to 250 ms, the alignment property is enhanced. As control in this Embodiment, in the case where an operator selects "coat paper" in paper type selection in the operation panel of the image forming apparatus A or on a user interface connected to the image forming apparatus A, and in the case of selecting sheets less than predetermined weighing (herein less than about 60 g/m$^2$), it is configured to perform the above-mentioned control. In the case where there is an allowance in capacity of memory and the like, or finer control is required, by beforehand storing information on air permeance already described for each type of coat paper, or beforehand storing weighing information for each type of sheet, control may be varied with the selected sheet.

The neat control circuit 75 receives position setting information and sheet size information of sheets discharged from the discharge opening 69, from the post-processing control section 81, moves down the pair of neat alignment plates 73 from the retract positions to the first stacking means 26 by the rotation drive mechanism 77, while shifting the pair of neat alignment plates 73, along the alignment plate rotation shaft member 72, to the receive preparation positions disposed at the interval of sheet width+$\alpha$ with the center in the width direction of the sheet or sheet bunch discharged from the discharge opening 69 as the reference. At the same time, the neat control circuit 75 moves down the paddle apparatus 74 from the waiting position to the operation position by the paddle up-and-down mechanism 79, and rotates the paddle member 74*b* by the paddle rotation drive mechanism 78. Further, when the sheet discharged from the discharge opening 69 is scraped off to the first stacking means 26 by the paddle member 74*b* and is placed on the first stacking means 26, the neat control circuit 75 shifts the pair of neat alignment plates 73 to the alignment positions by the shaft-direction drive mechanism 76 to strike the side edges in the width direction of the sheet or sheet bunch, and aligns the sheet or sheet bunch in a predetermined position. When alignment operation is completed, the neat alignment plate 73 is returned to the retract position to receive the next sheet by the rotation drive mechanism 77, and the paddle apparatus 74 is also moved up to the waiting position. Thus, alignment operation is performed on the first stacking means 26.

Figure 10:
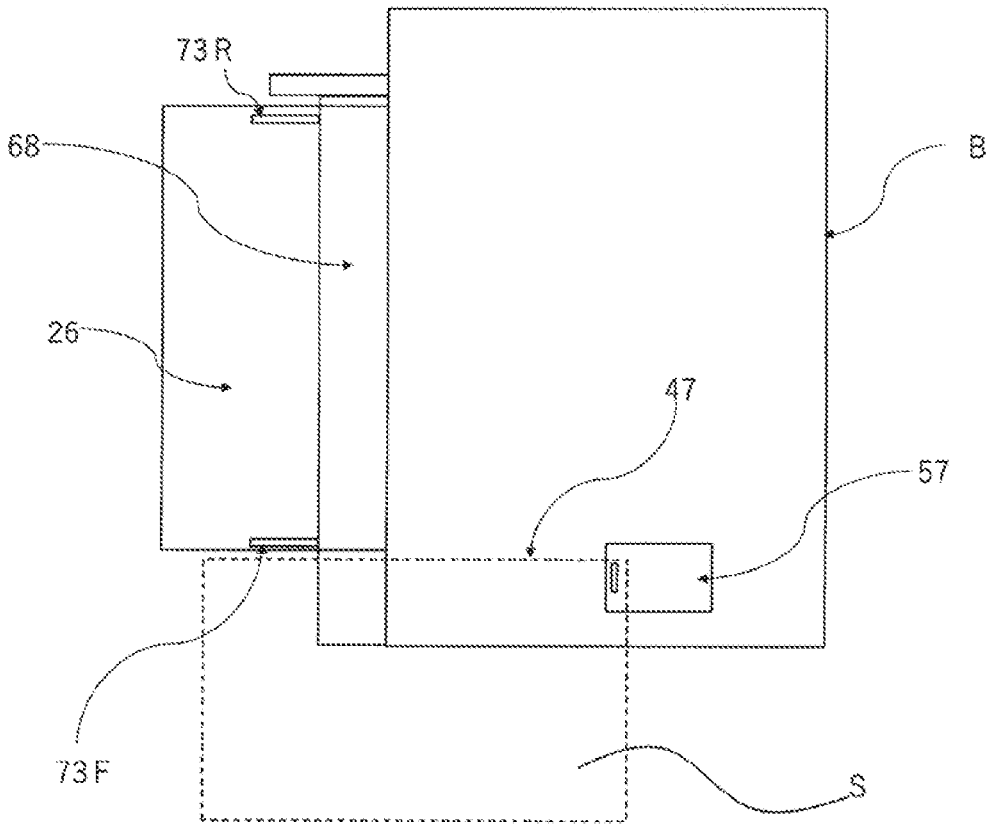
FIG. 10 is an explanatory view illustrating a position relationship among neat alignment plates of the neat alignment apparatus, regulation surface positioned on the apparatus rear side of the manual set section and sheets which are inserted in the manual set section and are struck by the regulation surface.

In addition, also in the case where the movable range of the neat alignment plate 73F on the front side of the pair of neat alignment plates 73 is set to overlap with the manual feed opening 70, at least under the mode for allowing an operator to insert a sheet bunch in the manual feed opening 70, the neat control circuit 75 sets the front-side limit position of the movable range to be on the rear side than the manual feed opening 70. By this means, it is possible to prevent the neat alignment plate 73F from interfering with insertion of the sheet bunch in the manual feed opening 70. Further, under the mode for allowing an operator to insert a sheet bunch in the manual feed opening 70, with respect to the front-side limit position of the movable range of the neat alignment plate 73F on the front side, as shown in FIG. 10, it is preferable that the neat control circuit 75 shifts the neat alignment plate 73F on the front side so that the surface on the front side of the front-side neat alignment plate 73F disposed in the front-side limit position is disposed in the vicinity and parallel of/with the rear-side end edge of the manual feed opening 70. By this means, since the surface on the front side of the neat alignment plate 73F on the front side functions as a guide of the sheet inserted in the manual feed opening 70, in manually feeding large-size sheets and sheets of low stiffness to bind, the guided area is increased to prevent the binding position and binding angle from being significantly displaced, and it is possible to improve operability. Further, the sheet inserted in the manual feed opening 70 is prevented from accidentally contacting already stacked sheets on the load tray 26, and it is thereby possible to prevent the alignment property from being disturbed or the offset sorted state from being in disorder. Furthermore, since the surface on the front side of the front-side neat alignment plate 73F is disposed parallel with the rear-side end edge of the manual feed opening 70, it is possible to make a sign to bind in a correct binding position in manually feeding the sheet by a visual check.

In addition, a rotation position to which the neat alignment plate 73F is shifted by the rotation drive mechanism 77 in guiding in the front-side limit position may be the retract position, or may be the operation position.

Figure 11A:
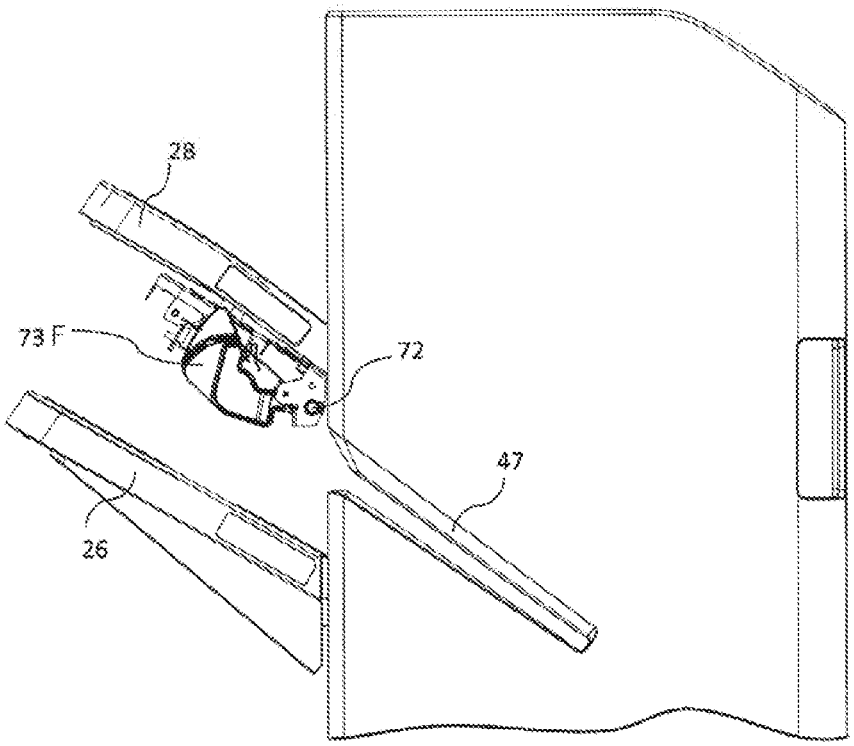
FIG. 11A is an explanatory view illustrating a state in which the neat alignment plate of the neat alignment apparatus is in a waiting position.
Figure 11B:
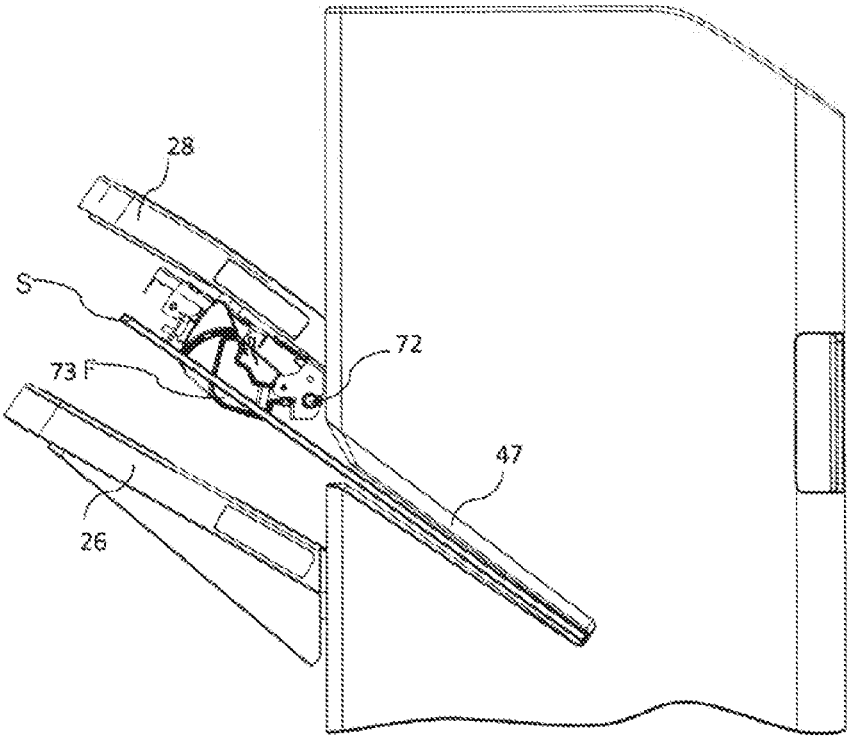
FIG. 11B is an explanatory view illustrating a state in which manually fed sheets are guided when the neat alignment plate is in the waiting position.

FIG. 11A illustrates a state in which the neat alignment plate 73F is positioned in the retract position in the front-side limit position, and FIG. 11B illustrates a state in which a sheet is inserted in the manual feed opening 70. In the state in which the neat alignment plate 73F is in the waiting position, the state is a suitable state for guiding the sheet S inserted in an extension of the manual feed opening 70.

Figure 12A:
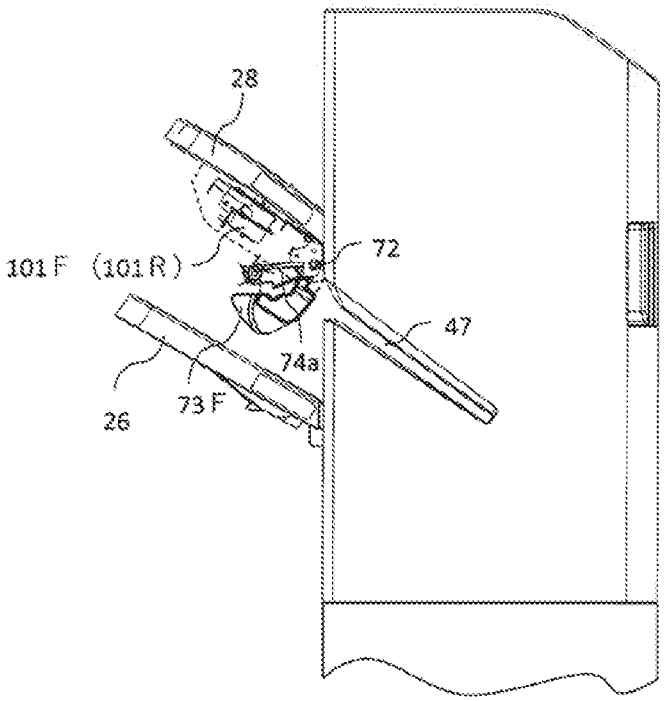
FIG. 12A is an explanatory view illustrating a state in which the neat alignment plate of the neat alignment apparatus is in an operation position.
Figure 12B:
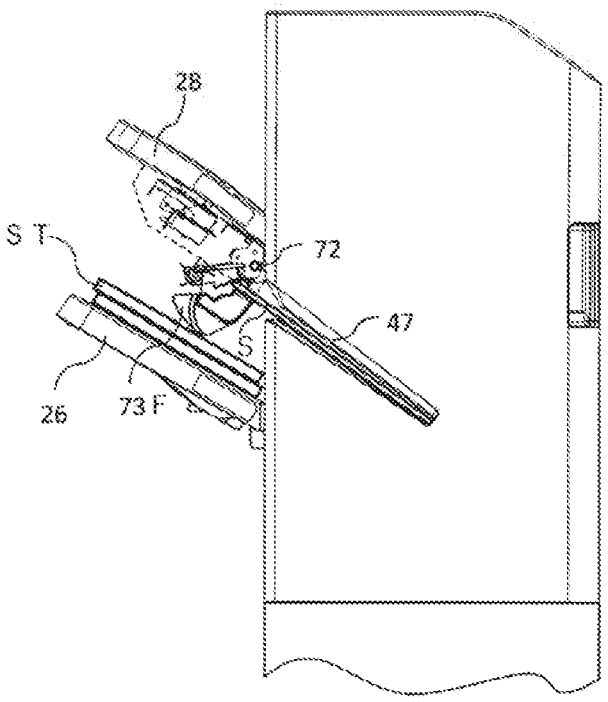
FIG. 12B is an explanatory view illustrating a state in which manually fed sheets are guided when the neat alignment plate is in the operation position.

FIG. 12A illustrates a state in which the neat alignment plate 73F is positioned in the operation position in the front-side limit position, and FIG. 12B illustrates a state in which a sheet is inserted in the manual feed opening 70. In the state in which the neat alignment plate 73F is in the operation position, since the position relationship is made so as to protect an already stacked sheet bunch ST stacked on the stacking tray 26, the sheet S hardly contacts the already stacked sheet bunch ST, and such a state is an effective state in the case of placing importance on the alignment property of sheets on the stacking tray 26.

Further, since the neat alignment apparatus 68 is provided with the neat control circuit 75, it is possible to control operation of the neat alignment apparatus 68, only by receiving, from the main body control section 80, the position setting and sheet size information of the sheet discharged from the processing tray 40. Accordingly, also in the case where attachment of the neat alignment apparatus 68 is made option, without performing changes in the control program of the main body control section 80 and changes in structural design, only by performing signal wiring between the main body control section 80 and the neat control circuit 75, it is possible to attach the neat alignment apparatus 68, and additional installation is made ease.

In the case where the neat alignment apparatus 60 is installed as an option unit, it is necessary to adjust the position of the neat alignment apparatus, and particularly, the position of the neat alignment plate 73 in the sheet width direction is related to the alignment property, and is thereby important. In this Embodiment, by connecting between the neat control circuit 75 and the post-processing control section 81, the post-processing control section 81 is configured to reflect an adjusted value for adjusting the side edge alignment plates 56 so that the center of sheet transport matches with the alignment center position in the width direction orthogonal to the sheet transport direction, as an adjusted value of the neat alignment plates 73. By this means, not only omitting an effort for newly adjusting after installing the neat alignment apparatus, but also in the case of adjusting the position of the side edge alignment plate 56 by the post-processing control section 81, since the neat alignment plate 73 is also adjusted via the neat control circuit 75 at startup of the apparatus, it is thereby possible to adjust easily.

Further, as shown in FIGS. 15 and 16, the front-side cover (neat alignment apparatus front cover) 86 of the neat housing positioned in the vicinity of the sheet support surface 47*b* is provided with an introducing shape in accordance with the angle of the sheet support surface 47*b*. By this means, also in the case where a part of the neat alignment apparatus 68 is extended so as to protrude to the sheet support surface 47*a* side, while maximizing the movable range of the neat alignment plate, it is possible to provide the apparatus without interfering with insertion of a sheet in the manual feed opening 70 by an operator.

As described above, by referring to the Embodiment shown in the figure, the sheet stacking apparatus and the sheet processing apparatus and image forming system provided with the stacking apparatus of the present invention are described, but the invention is not limited to the Embodiment shown in the figure. For example, in the Embodiment shown in the figure, the neat alignment apparatus 68 is installed above the first stacking means 26, and it is also possible to provide the neat alignment apparatus 68 above another stacking means.

This application claims priority based on Japanese Patent Application No. 2019-025251 filed on Feb. 15, 2019 and Japanese Patent Application No. 2019-025257 filed on Feb. 15, 2019, the entire contents of which are expressly incorporated by reference herein.

The invention claimed is:

1. A sheet processing apparatus comprising:

an apparatus housing;

a transport section provided inside the apparatus housing to transport a sheet in a predetermined transport direction;

a collecting section adapted to collect sheets transported by the transport section to perform predetermined processing;

a discharge section adapted to discharge the sheets from the collecting section;

a stacking section provided on a downstream side of the collecting section in the transport direction outside the apparatus housing to stack sheets transported by the transport section or the discharge section;

an alignment section provided on the downstream side of the collecting section in the transport direction, above the stacking section, to be able to shift in a predetermined movable region so as to align a sheet width direction orthogonal to the transport direction of the sheet to be stacked on the stacking section;

a shaft-direction drive mechanism adapted to shift the alignment section in the sheet width direction orthogonal to the transport direction;

an alignment plate rotation shaft member adapted to axially support the alignment section rotatably;

a shaft-direction drive source adapted to operate the shaft-direction drive mechanism; and a neat housing adapted to store the shaft-direction drive mechanism and the alignment plate rotation shaft member inside the neat housing, wherein the shaft-direction drive source is disposed on the downstream side of the alignment plate rotation shaft member in the transport direction, inside the neat housing.

2. The sheet processing apparatus according to claim 1, wherein the stacking section is provided with an inclined stacking section with a predetermined inclined angle such that a downstream side is gradually higher than an upstream side in the transport direction of a placement face, and in a position opposed to the inclined stacking section of the neat housing is provided an inclined cover having an inclined angle substantially parallel with the predetermined inclined angle of the inclined stacking section.

3. The sheet processing apparatus according to claim 2, wherein the inclined cover guides a sheet during transport.

4. The sheet processing apparatus according to claim 3, further comprising:

radial ribs in a guide face of the inclined cover for guiding a sheet.

5. The sheet processing apparatus according to claim 2, wherein on the downstream side of the inclined cover in the transport direction, inclination with an angle steeper than the predetermined inclined angle is provided in a face opposed to the inclined stacking face.

6. The sheet processing apparatus according to claim 1, wherein the neat housing is provided with a scrapping paddle to scrape off the sheet discharged by the transport section or the discharge section to the stacking section.

7. The sheet processing apparatus according to claim 6, wherein the alignment section is comprised of a pair of alignment plates for nipping the sheet in the sheet width direction from an apparatus front side and an apparatus rear side, and the shaft-direction drive source of the alignment section is provided to drive each of the alignment plates on the apparatus front side and the apparatus rear side independently.

8. The sheet processing apparatus according to claim 6, wherein the scraping paddle is provided on a rotation shaft, and the scraping paddle is supported by a paddle support member, and in storing the paddle support member in an inclined face forming portion of the neat housing, a backside of the paddle support member is used as a paper feeding face.

9. The sheet processing apparatus according to claim 1, further comprising:

a binding section adapted to perform binding processing on sheets collected in the collecting section.

10. The sheet processing apparatus according to claim 1, further comprising another stacking section located above the stacking section and attached to the apparatus housing outside the apparatus housing, the neat housing being located between the stacking section and another stacking section outside the apparatus housing.

11. An image forming system comprising:

an image forming apparatus adapted to form an image on a sheet to carry out the sheet with the image formed; and the sheet processing apparatus according to claim 1 adapted to stack the sheet carried out of the image forming apparatus.

* * * * *